US010477333B1

(12) United States Patent
Pogue et al.

(10) Patent No.: US 10,477,333 B1
(45) Date of Patent: Nov. 12, 2019

(54) AUDIO PLACEMENT ALGORITHM FOR DETERMINING PLAYBACK DELAY

(71) Applicant: Amazon Technologies, Inc., Seattle, WA (US)

(72) Inventors: Michael Alan Pogue, Sunnyvale, CA (US); Hanoch Freund, San Jose, CA (US)

(73) Assignee: Amazon Technologies, Inc., Seattle, WA (US)

( * ) Notice: Subject to any disclaimer, the term of this patent is extended or adjusted under 35 U.S.C. 154(b) by 39 days.

(21) Appl. No.: 15/363,812

(22) Filed: Nov. 29, 2016

(51) Int. Cl.
*H04R 29/00* (2006.01)
*H04R 27/00* (2006.01)
*H04R 3/12* (2006.01)

(52) U.S. Cl.
CPC ..... *H04R 27/00* (2013.01); *H04R 3/12* (2013.01); *H04R 2420/07* (2013.01)

(58) Field of Classification Search
CPC ..... H04R 3/12; H04R 29/00
USPC ..... 381/56, 58, 79
See application file for complete search history.

(56) References Cited

U.S. PATENT DOCUMENTS 7,269,524 B1 * 9/2007 Ong ..... H03L 7/0814 702/107
9,246,545 B1 * 1/2016 Ayrapetian ..... H04M 9/082
2002/0046288 A1 * 4/2002 Mantegna ..... G10L 19/18 709/234
2002/0177996 A1 * 11/2002 Cooper ..... G01R 23/16 704/205
2006/0256970 A1 * 11/2006 Asada ..... H04S 7/301 381/17
2015/0032788 A1 * 1/2015 Velazquez ..... H04L 27/265 708/819
2016/0014373 A1 * 1/2016 LaFata ..... H04N 7/152 348/14.08
2017/0064154 A1 * 3/2017 Tseng ..... H04N 5/04

* cited by examiner

*Primary Examiner* — Katherine A Faley
(74) *Attorney, Agent, or Firm* — Pierce Atwood LLP

(57) ABSTRACT

A system capable of synchronizing audio by determining a playback delay between when an audio sample is sent to and then output from a speaker. The system may generate a test signal configured to reach a saturation threshold and may send the test signal at a first time, followed by blank audio samples, from a first processor to a second processor to be output by the speaker. The second processor may detect that an audio sample exceeds a saturation threshold at a second time, generate a timestamp and send the timestamp to the first processor. The first processor may determine a playback delay between the first time and the second time and may also determine a number of blank audio samples sent between the first time and the second time. Using the playback delay and the number of blank audio samples, the system may generate audio using precise timing.

22 Claims, 15 Drawing Sheets

AUDIO PLACEMENT ALGORITHM FOR DETERMINING PLAYBACK DELAY

BACKGROUND

With the advancement of technology, the use and popularity of electronic devices has increased considerably. Multiple electronic devices may be used to play audio at the same time. The devices may perform audio placement in order to output an audio sample at the exact correct time across multiple devices. When audio samples are played at exactly the correct time, the audio is synchronized and a user may hear the audio at the same time. Disclosed herein are technical solutions to improve audio placement.

BRIEF DESCRIPTION OF DRAWINGS

For a more complete understanding of the present disclosure, reference is now made to the following description taken in conjunction with the accompanying drawings.

DETAILED DESCRIPTION

Figure 1:
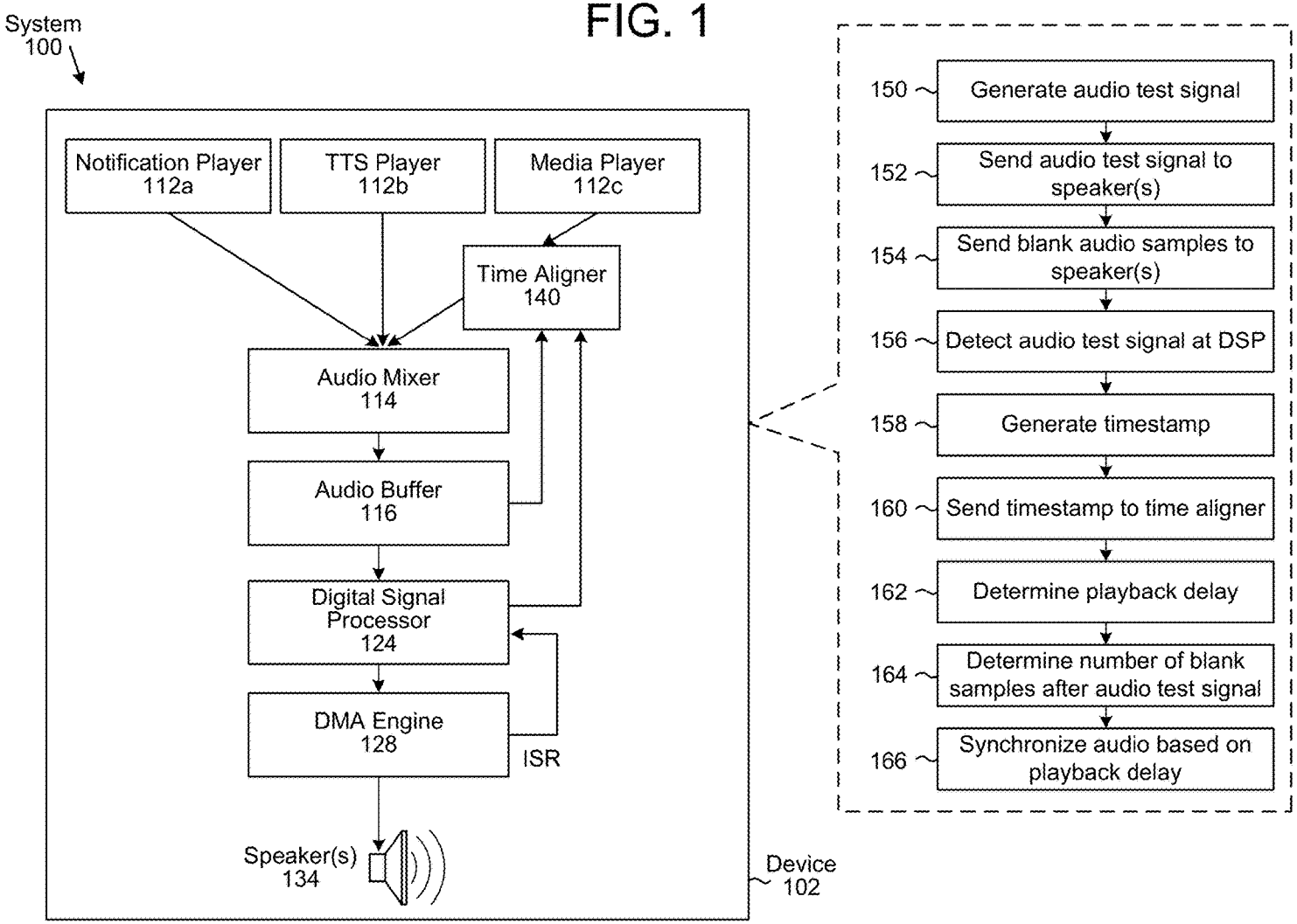
FIG. 1 illustrates a high-level conceptual block diagram of a system configured to perform audio placement according to embodiments of the present disclosure.

Multiple electronic devices may be used to play audio at the same time. The devices may perform audio placement in order to output an audio sample at the exact correct time across multiple devices. During audio playback, a device may divide audio data into frames of audio data, with each frame of audio data including a fixed number of audio samples (e.g., 8 ms of audio data). The device may add the frames of audio data to an audio pipeline to be output by a speaker and the speaker may output a single audio sample at a time. When audio samples are played at exactly the correct time by each of the multiple devices, the audio is synchronized and a user may hear audio from each of the devices at the same time.

Some devices perform audio placement using a processor at the end of the audio pipeline. For example, a device may include timing information (e.g., a timestamp) with each frame of audio data to enable a processor located just before the speaker in the audio pipeline to perform the audio placement. Due to the proximity between the processor and the speaker in the audio pipeline, there is a fixed delay between the processor sending the audio sample and the audio sample being output by the speaker, enabling the processor to precisely control when the audio sample is output. For example, if the processor is about to output a first audio sample of a frame at time 1000 μs, but a corresponding timestamp indicates that the frame should start at time 1020 μs, the processor may add audio samples before the first audio sample in order to delay the frame so that the speaker outputs the first audio sample at the correct time of 1020 μs. Alternatively, if the processor is expecting to output the first audio sample at 1030 μs but a timestamp indicates that the first audio sample should start at time 1020 μs, the processor may skip audio samples so that the speaker outputs the first audio sample at the correct time of 1020 μs. Thus, the processor may output the audio samples at the correct time based on the timing information associated with each frame of audio data.

Other devices perform audio placement using a processor at a beginning of the audio pipeline. For example, some devices may not be able to include timing information with each frame of audio data. If the size of the audio pipeline is known, the processor at the beginning of the audio pipeline may perform audio placement by controlling when an audio sample is added to the audio pipeline. For example, the processor may add audio samples in order to output the next audio sample at a later time or may skip audio samples in order to output the next audio sample at an earlier time. Thus, when the size of the audio pipeline is known, the processor may precisely control when the audio sample is output by the speaker. However, the device may not know a size of the audio pipeline and may therefore not know when an audio sample added to the audio pipeline will actually be output by the speaker.

To improve audio placement and/or synchronization of audio output by separate devices, devices, systems and methods are disclosed that may determine a playback delay between when an audio sample is added to an audio pipeline and when the audio sample is output from the audio pipeline to a speaker. For example, a first component may generate a test signal corresponding to a saturation threshold and may send the test signal to a second component at a first time, followed by blank audio samples. The second component may detect that an audio sample exceeds the saturation threshold at a second time, generate a timestamp and send the timestamp to the first component. The first component may determine a playback delay between the first time and the second time and may also determine a number of blank audio samples sent between the first time and the second time, which corresponds to a number of audio samples currently in the audio pipeline. Based on the playback delay and the number of audio samples in the audio pipeline, the system may add audio samples to the audio pipeline in order to output the next audio sample at a later time or may skip audio samples in the audio pipeline in order to output the next audio sample at an earlier time. Thus, the system may precisely control when the next audio sample is added to the audio pipeline so that the next audio sample is output by the speaker at the correct time.

FIG. 1 illustrates a high-level conceptual block diagram of a system configured to perform audio placement according to embodiments of the present disclosure. Audio placement corresponds to playing a particular audio sample at the exact correct time across multiple speakers and/or devices. When the audio samples are played at exactly the correct time, the audio is synchronized and a user may hear the audio from different speakers at the same time. As illustrated in FIG. 1, the system 100 may include a device 102 that sends audio samples to speaker(s) 134 to be output as audio. The device 102 may receive audio data from a remote device (not shown) along with an indication of the correct time with which to output the audio data. For example, the device 102 may correspond to a wireless speaker and may receive the audio data and the correct time from a device that has a user interface, such as a speech enabled device, a laptop, a smartphone or the like. However, the disclosure is not limited thereto and the device 102 may be any electronic device that includes speaker(s) 134. The correct time may be indicated using a common time base for all devices and the device 102 may translate the common time base into a local time.

During audio playback, the device 102 may divide audio data into frames of audio data, with each frame of audio data including a fixed number of audio samples (e.g., 8 ms of audio data). For example, when the speaker(s) 134 operate using a 48 kHz clock frequency, a frame of audio data may correspond to 8 ms of the audio data and may include 384 audio samples, with each audio sample corresponding to roughly 21 μs (e.g., 20.833 μs) of the audio data. The device 102 may send the audio data to the speaker(s) 134 by adding the frames of audio data to an audio pipeline to be output by the speaker(s) 134 and the speaker(s) 134 may output a single audio sample at a time. The audio pipeline may include multiple processes and/or multiple tasks, each of which having a buffer of unknown size. Therefore, the device 102 may not know a size of the audio pipeline.

As discussed above, audio placement may be performed by a first component associated with a beginning of the audio pipeline or a second component associated with an end of the audio pipeline. For example, if timing information was included with each frame of audio data, a digital signal processor (DSP) 124 located just before the speaker(s) 134 in the audio pipeline may perform the audio placement.

The system 100 illustrated in FIG. 1, however, does not include timing information with each frame of audio data. Instead, a time aligner 140 at a beginning of the audio pipeline is configured to perform the audio placement. As the audio pipeline includes multiple processes and/or multiple tasks, each of which have a buffer of unknown size, the time aligner 140 does not know a size of the audio pipeline.

In order to control the speaker(s) 134 to play an audio sample at the correct time, the time aligner 140 may determine a playback delay between when the audio sample is added to the audio pipeline (e.g., sent to the speaker(s) 134 at a first time) and when the audio sample is output from the audio pipeline (e.g., output by the speaker(s) 134 at a second time), as discussed in greater detail below. In addition, the time aligner 140 may determine a number of audio samples currently in the audio pipeline. For example, the time aligner 140 may determine a number of audio samples added to the audio pipeline between the first time and the second time. Based on the playback delay and the number of audio samples in the audio pipeline, the device 102 may output a next audio sample to the speaker(s) 134 such that audio output generated by multiple devices 102 and/or speaker(s) 134 are time-aligned with each other. For example, the time aligner 140 may add audio samples (e.g., blank audio samples having a value of zero) to the audio pipeline in order to delay the next audio sample or may skip audio samples (e.g., remove audio samples from the audio pipeline) in order to play the next audio sample sooner, such that the next audio sample added to the audio pipeline is output by the speaker(s) 134 at a coordinated time.

In some examples, the system 100 may synchronize a first audio sample in a group of audio samples (e.g., audio data corresponding to a song) using the playback delay and/or the number of audio samples currently in the audio pipeline and may synchronize remaining audio samples in the group of audio samples using other techniques, discussed in greater detail below. However, the disclosure is not limited thereto and the system 100 may synchronize two or more audio samples of the group of audio samples based on the playback delay and/or the number of audio samples currently in the audio pipeline without departing from the disclosure.

In order to determine the playback delay, the time aligner 140 may generate an audio test signal and may add the audio test signal to the audio pipeline at a first time. After adding the audio test signal to the audio pipeline, the time aligner 140 may add blank audio frames to the audio pipeline. The DSP 124 may detect the audio test signal at a second time, generate a timestamp corresponding to the second time, and send the timestamp to the time aligner 140. After being detected, the audio test signals may be removed from the audio pipeline prior to the speaker(s) 134, resulting in minimal audible effects. Based on the timestamp, the time aligner 140 may determine the playback delay between the first time and the second time. In addition, the time aligner 140 may determine a number of the blank audio samples added to the audio pipeline between the first time and the second time.

Typically, audio samples received by the DSP 124 do not have a positive peak value exceeding a positive saturation threshold or a negative peak value below a negative saturation threshold. Thus, the time aligner 140 may generate the audio test signal to include a first audio sample having a peak value equal to a relatively large positive value (e.g., maximum positive value) and a second audio sample having a peak value equal to a relatively large negative value (e.g., maximum negative value). As a result, the DSP 124 may detect the first audio sample by detecting an audio sample having a peak value exceeding the positive saturation threshold and may detect the second audio sample by detecting an audio sample having a peak value that is below the negative saturation threshold.

To illustrate an example, the audio samples may have a value represented by a signed integer, having a negative maximum (e.g., −32767) and a positive maximum (e.g., 32767). Thus, a positive saturation threshold may correspond to the positive maximum (e.g., 32767) or a value near to the positive maximum (e.g., 32000) and a negative saturation threshold may correspond to the negative maximum (e.g., −32767 or a value near to the negative maximum (e.g., −32000). However, the disclosure is not limited thereto and values of the saturation thresholds may vary without departing from the disclosure. In some examples, the saturation threshold may be lower (e.g., +/−28000) without departing from the disclosure, provided that the positive audio test signal exceeds the positive saturation threshold and the negative audio test signal is below the negative saturation threshold. Additionally or alternatively, the values of the audio samples may be represented by an unsigned integer without departing from the disclosure. For example, the negative saturation threshold may correspond to a value of zero, whereas the positive saturation threshold may correspond to a positive maximum (e.g., 65534).

In some examples the DSP 124 may detect both the first audio sample and the second audio sample, but the disclosure is not limited thereto. Instead, the DSP 124 may detect only one of the first audio sample or the second audio sample without departing from the disclosure. For example, the audio test signal may be combined with positive audio samples having a positive value. Due to the positive value, a combination of the positive audio samples and the second audio sample may not have a value that is below the negative saturation threshold. However, a combination of the positive audio samples and the first audio sample would have a value that exceeds the positive saturation threshold. Similarly, the audio test signal may be combined with negative audio samples having a negative value. Due to the negative value, a combination of the negative audio samples and the first audio sample may not have a value that exceeds the positive saturation threshold. However, a combination of the negative audio samples and the second audio sample would have a value that is below the negative saturation threshold. Thus, including the first audio sample and the second audio sample increases a likelihood that the DSP 124 may detect the audio test signal.

In the examples described herein, the audio test signal includes the first audio sample and the second audio sample so that regardless of other audio samples combined with the audio test signal, the DSP 124 will detect at least one audio sample having a peak value exceeding the positive saturation threshold or below the negative saturation threshold. However, the disclosure is not limited thereto and the audio test signal may include the first audio sample and/or the second audio sample without departing from the disclosure. For example, the audio test signal may include the first audio sample or the second audio sample multiple times. Additionally or alternatively, while the examples described herein describe the audio test signal as including a positive audio sample followed by a negative audio sample, the disclosure is not limited thereto and the audio test signal may include the positive audio sample and/or the negative audio sample in any order without departing from the present disclosure.

The device 102 may include audio sources 112, such as a notification player 112*a*, a text-to-speech (TTS) player 112*b* and a media player 112*c*. The notification player 112*a* may generate notifications, such as beeping noises or other audio signals indicating an event. The TTS player 112*b* may generate text to speech, such as acknowledgement of voice commands, speech indicating a command being performed, responses to voice commands and/or other speech directed to a user. The media player 112*c* may generate audio corresponding to media such as videos, music, audiobooks, podcasts or the like. For example, the media player 112*c* may generate audio samples corresponding to the synchronized audio output by multiple devices 102 and/or speaker(s) 134.

Audio samples from the notification player 112*a*, the text-to-speech (TTS) player 112*b* and the media player 112*c* may be combined using an audio mixer 114 and the combined audio samples may be stored in an audio buffer 116. For example, the audio mixer 114 may combine audio samples received from the notification player 112*a*, the TTS player 112*b* and/or the media player 112*c* using saturating arithmetic. Thus, when a sum of the audio samples exceeds a positive saturation threshold, the audio mixer 114 clips the arithmetic at the positive saturation threshold and outputs the positive saturation threshold instead of wrapping around. Similarly, when a sum of the audio samples is below a negative saturation threshold, the audio mixer 114 clips the arithmetic at the negative saturation threshold and outputs the negative saturation threshold instead of wrapping around. The audio buffer 116 may store the combined audio samples and output the combined audio samples to the DSP 124.

As illustrated in FIG. 1, the audio buffer 116 outputs the combined audio samples to the DSP 124. The DSP 124 may output the audio samples to a direct memory access (DMA) engine 128, which may receive a buffer of audio samples and generate an output. For example, the DMA engine 128 may operate continuously, such that once the DMA engine 128 is finished with a first frame of audio data, the DMA engine 128 may request a second frame of audio data. While FIG. 1 omits several components of the device 102, audio samples output by the DMA engine 128 are sent to the speaker(s) 134 and the speaker(s) 134 may generate audio based on the audio samples.

Audio placement may be performed by a time aligner 140 included in the device 102. The time aligner 140 may be configured to resample audio samples, add audio samples and/or drop audio samples, along with additional processing or other functional. For example, in order to determine the playback delay the time aligner 140 may generate the audio test signal. For example, the time aligner 140 may receive audio samples from the media player 112*c* and may generate the first audio sample having the positive value and the second audio sample having the negative value based on the received audio samples. In some examples, the time aligner 140 may modify existing values of the received audio samples to generate the audio test signal. However, the disclosure is not limited thereto and the time aligner 140 may generate the audio test signals during blank audio samples (e.g., audio samples that don't include any data) or the like.

The time aligner 140 may send the audio test signal to the audio mixer 114 at a first time, followed by blank audio frames. Sending audio samples to the audio mixer 114 may correspond to adding the audio samples to the audio pipeline. In some examples, the time aligner 140 may generate a first timestamp corresponding to the first time. The audio mixer 114 may combine the audio test signal with other audio samples from the notification player 112*a* and/or the TTS player 112*b*. Due to the first audio sample being followed by the second audio sample, at least one of the combined audio samples is likely to be saturated (e.g., clipped at the positive saturation threshold or the negative saturation threshold). If peak values of the audio samples being combined with the audio test signal are small enough, a first combined audio sample may be saturated (e.g., clipped at the positive saturation threshold) in a positive direction and a second combined audio sample may be saturated in a negative direction (e.g., clipped at the negative saturation threshold).

The audio mixer 114 may output the combined audio samples to the audio buffer 116, which may output to the DSP 124. The DSP 124 may apply digital signal processing to the combined audio samples, such as performing equalization, range control and/or other processing. In addition, the DSP 124 may detect the audio test signal by detecting that at least one of the combined audio samples has a peak value above the positive saturation threshold or below the negative saturation threshold. Thus, the DSP 124 may detect the audio test signal within a frame of audio data and determine a precise position of the audio test signal within the frame of audio data (e.g., number of audio samples from a beginning of the frame to the audio test signal).

The DSP 124 may output the combined audio samples to the DMA engine 128, which may receive a frame of audio samples at a time and may sequentially output each of the audio samples to the speaker(s) 134 for audio playback. Thus, the DMA engine 128 may operate continuously, such that once the DMA engine 128 is finished with a first frame of audio data, the DMA engine 128 may request a second frame of audio data from the DSP 124. When the DMA engine 128 is finished with the first frame of audio data, the DMA engine 128 may generate an interrupt service routine (ISR) and send the ISR to the DSP 124.

The ISR indicates to the DSP 124 that the DMA engine 128 is ready to receive a second frame of audio data. In response to receiving the ISR, the DSP 124 may send the DMA engine 128 the second frame of audio data. In addition, the DSP 124 previously detected the audio test signal within the second frame of audio data and determined a precise position of the audio test signal within the second frame of audio data (e.g., number of audio samples from a beginning of the second frame to the audio test signal). As the rest of the audio pipeline is completely deterministic (e.g., the DMA engine 128 outputs audio samples sequentially to the speaker(s) 134 for audio playback), the DSP 124 may determine exactly when the audio test signal will be output by the speaker(s) 134 based on the precise position of the audio test signal within the second frame of audio data and the ISR, which indicates a beginning of the second frame.

After receiving the ISR, the DSP 124 may generate a second timestamp corresponding to a second time and may send the second timestamp to the time aligner 140. In some examples the second time corresponds to when the audio test signal will be output by the speaker(s) 134. For example, the DSP 124 may calculate the second time based on the ISR and the precise position of the audio test signal within the second frame. However, the disclosure is not limited thereto and the second time may instead correspond to when the ISR is received by the DSP 124. For example, the DSP 124 may send the second timestamp and position information of the audio test signal within the second frame to the time aligner 140 and the time aligner 140 may determine when the audio test signal will be output by the speaker(s) 134 without departing from the disclosure. Additionally or alternatively, the DSP 124 may send the position information (e.g., frame number and sample number within the frame associated with the audio test signal) and the DMA engine 128 may send the second timestamp in response to the ISR.

Based on the first timestamp and the second timestamp, the time aligner 140 may determine the playback delay. For example, the time aligner 140 may subtract the second timestamp from the first timestamp to determine the playback delay. In addition, the time aligner 140 may determine a number of audio samples currently in the audio pipeline by determining a number of blank audio frames added to the audio pipeline (e.g., sent from the time aligner 140 to the audio mixer 114) between the first time (e.g., first timestamp) and the second time (e.g., second timestamp). Based on the playback delay and the number of audio samples in the audio pipeline, the time aligner 140 may add audio samples (e.g., blank audio samples having a value of zero) to the audio pipeline in order to delay the next audio sample or may skip audio samples (e.g., remove audio samples from the audio pipeline) in order to play the next audio sample sooner, such that the next audio sample added to the audio pipeline is output by the speaker(s) 134 at a specific time.

As illustrated in FIG. 1 and discussed in greater detail above, the time aligner 140 may generate (150) an audio test signal and may send (152) the audio test signal to the speaker(s) 134 by adding the audio test signal to the audio pipeline at a first time. The time aligner may generate a first timestamp associated with the first time at which the audio test signal is added to the audio pipeline. The time aligner 140 may send (154) blank audio samples to the speaker(s) 134 by adding the blank audio samples to the audio pipeline.

The DSP 124 may detect (156) the audio test signal at a second time, may generate (158) a second timestamp corresponding to the second time, and may send (160) the second timestamp to the time aligner 140.

The time aligner 140 may determine (162) the playback delay. For example, the time aligner 140 may determine a difference between the first timestamp and the second timestamp (e.g., difference between the first time and the second time). The time aligner 140 may determine (164) the number of blank samples added to the audio pipeline after the audio test signal (e.g., between the first time and the second time). Using the playback delay and the number of blank samples, the time aligner 140 may synchronize (166) audio based on the playback delay. For example, the time aligner 140 may add audio samples (e.g., blank audio samples having a value of zero) to the audio pipeline in order to delay the next audio sample or may skip audio samples (e.g., remove audio samples from the audio pipeline) in order to play the next audio sample sooner, such that the next audio sample added to the audio pipeline is output by the speaker(s) 134 at a specific time.

In order to synchronize audio data between multiple speaker(s) 134 and/or multiple devices 102, the system 100 may also compensate for differences in clock frequencies between different integrated circuits. For example, a first device (e.g., first wireless speaker) may have a first clock frequency associated with a first audio pipeline and a second device (e.g., second wireless speaker) may have a second clock frequency associated with a second audio pipeline. By synchronizing the first clock frequency and the second clock frequency, the first device and/or the second device may perform audio placement and output audio at the same time, despite separate audio pipelines. In some examples, the first device and/or the second device may use the techniques disclosed herein to perform audio placement. Additionally or alternatively, a first processor of the device 102 may have a first clock frequency and a second processor of the device 102 may have a second clock frequency. Thus, two processors associated with a single audio pipeline may have two separate clock frequencies, and converting between the clock frequencies may be included as part of audio placement.

A clock frequency corresponds to a timing clock signal produced by a crystal oscillator, such as an electronic oscillator circuit that uses the mechanical resonance of a vibrating crystal of piezoelectric material to create an electrical signal with a precise frequency. An integrated circuit may use the clock frequency as a measure of time, such as by timing operations of the integrated circuit based on the cycles of the clock frequency. For example, the electrical signal may be used to increment a counter that counts each "tick" of the electrical signal, such as a high resolution timer configured to provide high-resolution elapsed times. A clock frequency of 48 kHz corresponds to 48,000 ticks of the electrical signal per second. Thus, the high resolution timer may have a first value (e.g., 24000) at a first time and may generate a first timestamp indicating the first value. Over time, the high resolution timer may increment with each tick of the electrical signal (e.g., 24001, 24002, etc.), may have a second value (e.g., 36000) at a second time and may generate a second timestamp indicating the second value. The first timestamp and the second timestamp may be compared to determine a difference in time between the first time and the second time. If there is a difference between otherwise identical clock frequencies, these differences can result in some devices operating faster or slower than others.

A problem for generating synchronized audio occurs when a first integrated circuit has a different sampling rate (e.g., clock frequency) than a second integrated circuit. This can occur between two devices, between two integrated circuits included in a single device, and/or between a device and a loudspeaker (e.g., the loudspeaker may have its own crystal oscillator that provides an independent clock signal). Thus, the audio data that the device transmits to the loudspeaker may be output at a subtly different sampling rate by the loudspeaker, such that a playback rate of the audio is subtly different than the audio data that had been sent to the loudspeaker. For example, consider loudspeakers that transfer audio data using a 48 kHz sampling rate (i.e., 48,000 digital samples per second of analog audio signal). An actual rate based on a first integrated circuit's clock signal might actually be 48,000.001 samples per second, whereas another integrated circuit's clock signal might operate at an actual rate of 48,000.002 samples per second. This difference of 0.001 samples per second between actual frequencies is referred to as a frequency offset. The consequences of a frequency offset is an accumulated drift in the timing between the integrated circuits over time. Uncorrected, after one-thousand seconds, the accumulated drift is an entire sample of difference between integrated circuits.

Using techniques known to one of skill in the art, the frequency offset and/or drift between different sampling rates can be measured and corrected. Thus, during playback of synchronized audio (e.g., while the speaker(s) 134 are producing audio corresponding to audio samples), the device 102 may add or remove a certain number of digital samples per second in order to compensate for the frequency offset between a local sampling rate (e.g., first clock frequency associated with the device 102) and a master sampling rate (e.g., second clock frequency associated with a remote device). For example, the device 102 may add at least one sample per second when the frequency offset is positive and may remove at least one sample per second when the frequency offset is negative. Therefore, first audio samples sent to a first speaker 134 may be aligned with second audio samples sent to a second speaker 134, such that the first audio samples are output by the first speaker and the second audio samples are output by the second speaker at roughly the same time (e.g., substantially simultaneously).

In order to compensate for the frequency offset and/or the drift between sampling rates on different devices, the device 102 may perform audio placement, as illustrated in FIG. 1 and the following drawings, to synchronize a beginning of audio data between multiple devices. For example, the audio placement may ensure that a first sample of audio data is output by the speaker(s) 134 at a correct time. After synchronizing the first sample of audio data, the techniques known to one of skill in the art may compensate for frequency offset and/or drift during playback of the remaining samples of audio data.

Figure 2:
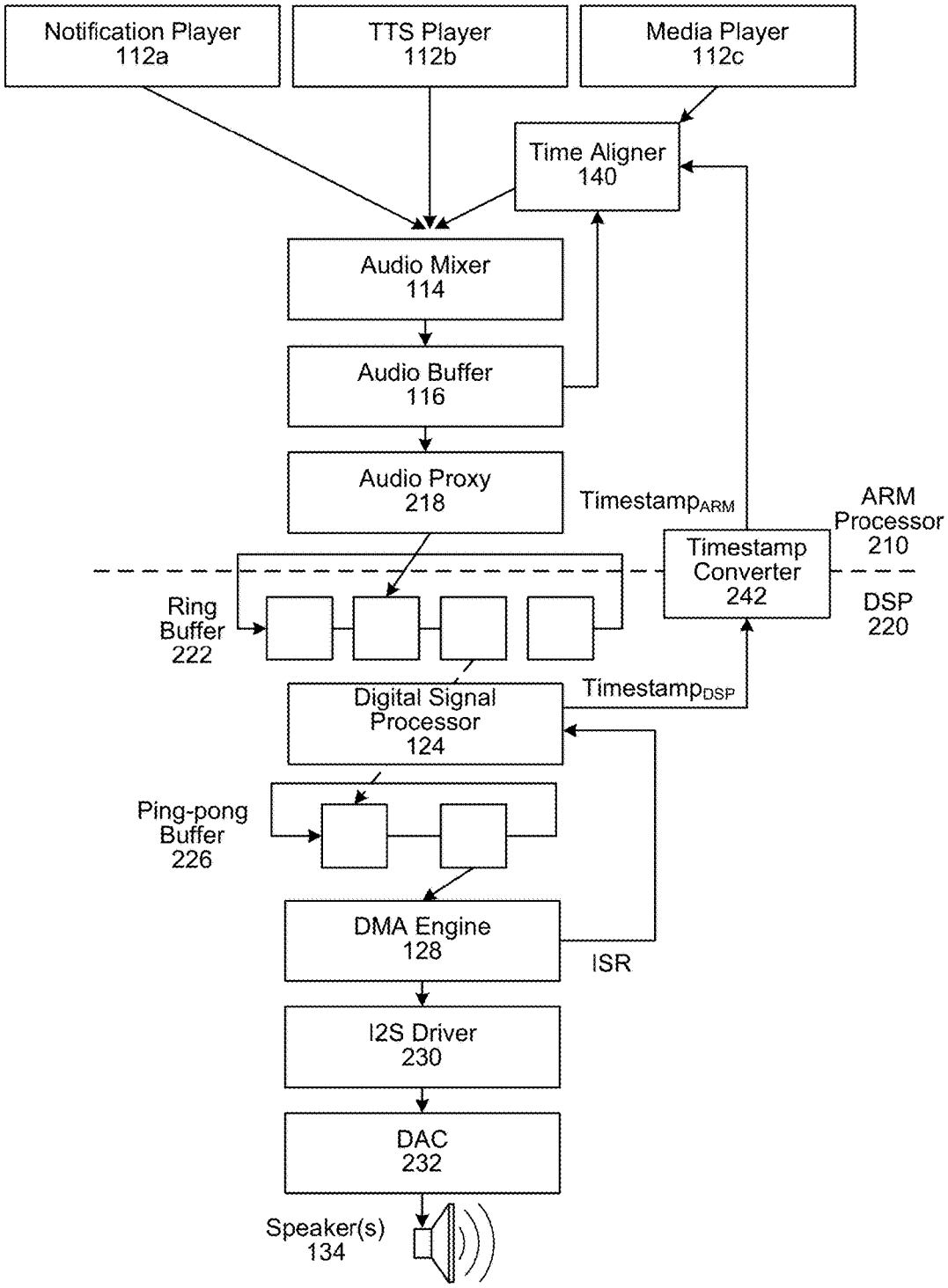
FIG. 2 illustrates example components of a device configured to perform audio placement according to embodiments of the present disclosure.

In some examples, the device 102 may compensate for a frequency offset and/or drift between a first processor and a second processor included in the device 102. For example, the device 102 may include an advanced RISC Machines (ARM) processor 210 associated with a beginning of the audio pipeline and a Digital Signal Processor (DSP) 220 associated with an ending of the audio pipeline, as illustrated in FIG. 2. While FIG. 2 illustrates the ARM processor 210 and the DSP 220, the disclosure is not limited thereto and the processors may vary without departing from the disclosure. During playback of audio, the device 102 may send audio samples from the ARM processor 210 to the DSP 220 and the DSP 220 may send the audio samples to the speaker(s) 134. As used herein, the DSP 124 may correspond to the DSP 220 or to a component included in the DSP 220 without departing from the disclosure. For example, the DSP 124 may correspond to a portion of code that is executed by the DSP 220, although the disclosure is not limited thereto.

The ARM processor 210 may be associated with a first clock frequency (e.g., 1 GHz) and the DSP 220 may be associated with a second clock frequency (e.g., 800 MHz). In addition to operating at different frequencies, the first clock frequency and the second clock frequency may have other variations that result in timer offset, frequency offset and/or drift. While the ARM processor 210 and the DSP 220 communicate, the second clock frequency is not visible to the ARM processor 210 and the first clock frequency is not visible to the DSP 220. Thus, a first timestamp generated by the ARM processor 210 (e.g., using a first high resolution timer) cannot be compared to a second timestamp generated by the DSP 220 (e.g., using a second high resolution timer) without first synchronizing the clock frequencies and compensating for a timer offset (e.g., skew) between the first high resolution timer and the second high resolution timer, which may vary over time based on the frequency offset and/or drift.

To synchronize the clock frequencies and compensate for the timer offset, the frequency offset and/or drift between the ARM processor 210 and the DSP 220, the device 102 may generate a first timestamp using the first clock frequency and a second timestamp using the second clock frequency at one or more points in time. The device 102 may perform a timestamp exchange between the ARM processor 210 and the DSP 220 during an initialization step (e.g., when the device 102 is powered on) to determine the timer offset, the frequency offset and/or drift. After determining the timer offset, the frequency offset and/or drift, a timestamp generated by the DSP 220 (e.g., associated with the second clock frequency) may be translated or converted to a timestamp associated with the ARM processor 210 (e.g., associated with the first clock frequency) or vice versa. For example, a timestamp converter 242 illustrated in FIG. 2 may convert between the first clock frequency and the second clock frequency.

FIG. 2 illustrates example components of a device configured to perform audio placement according to embodiments of the present disclosure. As illustrated in FIG. 2, the ARM processor 210 may include audio sources 112, such as the notification player 112*a*, the text-to-speech (TTS) player 112*b* and the media player 112*c*. The notification player 112*a* may generate notifications, such as beeping noises or other audio signals indicating an event. The TTS player 112*b* may generate text to speech, such as acknowledgement of voice commands, speech indicating a command being performed, responses to voice commands and/or other speech directed to a user. The media player 112*c* may generate audio corresponding to media such as videos, music, audiobooks, podcasts or the like. For example, the media player 112*c* may generate audio samples corresponding to the synchronized audio output by multiple devices 102 and/or speaker(s) 134.

The media player 112*c* may send audio samples to the time aligner 140. The time aligner 140 may resample the audio samples, add audio samples and/or drop audio samples. In addition, the time aligner 140 may generate the audio test signals and/or the blank audio samples. The time aligner 140 may output the audio samples, including the audio test signals and/or the blank audio samples, to the audio mixer 114.

Audio samples from the notification player 112*a*, the text-to-speech (TTS) player 112*b* and the time aligner 140 may be combined by the audio mixer 114. For example, the audio mixer 114 may combine audio samples received from the notification player 112*a*, the TTS player 112*b* and/or the time aligner 140 using saturating arithmetic. Thus, when a sum of the audio samples exceeds a positive saturation threshold, which may correspond to the first audio sample included in the audio test signal, the audio mixer 114 clips the arithmetic at the positive saturation threshold and outputs the positive saturation threshold instead of wrapping around. Similarly, when a sum of the audio samples is below a negative saturation threshold, which may correspond to the second audio sample included in the audio test signal, the audio mixer 114 clips the arithmetic at the negative saturation threshold and outputs the negative saturation threshold instead of wrapping around.

The audio mixer 114 may output the combined audio samples to the audio buffer 116, which may store the combined audio samples and output the combined audio samples to an audio proxy 218. The audio proxy 218 may be configured as an interface between the ARM processor 210 and the DSP 220. For example, the audio proxy 218 may receive audio samples, divide the audio samples into frames of audio data and send the audio samples to the DSP 220.

As illustrated in FIG. 2, the audio proxy 218 may output the audio samples into a ring buffer 222, which may be configured to store the audio samples as separate frames of audio data. For example, the ring buffer 222 may include a first portion corresponding to a first frame, a second portion corresponding to a second frame, etc. As illustrated in FIG. 2, the ring buffer 222 may store audio samples received from the audio proxy 218 as the first frame of audio data in the first portion, while simultaneously outputting the second frame of audio samples stored in the second portion. The ring buffer 222 may be configured to pass audio samples from the ARM processor 210 to the DSP 220. Thus, the ring buffer 222 may be shared between the ARM processor 210 and the DSP 220 and may be included in the ARM processor 210 and/or the DSP 220. The ring buffer 222 may be configured to store a number of audio frames while only outputting a single audio frame at a time. For example, the audio proxy 218 may operate intermittently with variable timing but may output multiple audio frames, whereas a ping-pong buffer 226 may operate consistently with fixed timing but receive a single audio frame at a time.

The ring buffer 222 may output frames of audio samples to the ping-pong buffer 226 included in the DSP 220. For example, the ping-pong buffer 226 may be configured to output audio samples corresponding to a first frame of audio data stored in a first portion to the ping-pong buffer 226 while receiving and storing audio samples corresponding to a second frame of audio data in a second portion of the ping-pong buffer 226. After completely outputting the first frame of audio data from the first portion, the ping-pong buffer 226 may output audio samples corresponding to the second frame of audio data stored in the second portion to the ping-pong buffer 226 while receiving and storing audio samples corresponding to a third frame of audio data in the first portion. Thus, the ping-pong buffer 226 bounces between the first portion and the second portion, receiving and outputting frames of audio data at a time.

The DSP 124 may copy audio samples from the ring buffer 222 to the ping-pong buffer 226. The DSP 124 may apply digital signal processing to the combined audio samples, such as performing equalization, range control and/or other processing. In addition, the DSP 124 may detect the audio test signal by detecting that at least one of the combined audio samples has a peak value above the positive saturation threshold or below the negative saturation threshold. Thus, the DSP 124 may detect the audio test signal within a frame of audio data and determine a precise position of the audio test signal within the frame of audio data (e.g., number of audio samples from a beginning of the frame to the audio test signal).

The ping-pong buffer 226 may output frames of audio data to the DMA engine 128 one frame at a time. The DMA engine 128 may receive a single frame of audio samples from the ping-pong buffer 226 and may sequentially output each of the audio samples included in the frame. The DMA engine 128 may output audio samples and/or frames of audio samples to an Integrated Interchip Sound (I2S) Driver 230 that sends the audio samples to a digital-to-analog converter (DAC) 232 associated with the speaker(s) 134 for audio playback. The DAC 232 may convert the audio samples from a digital signal to an analog signal and the speaker(s) 134 may produce audible sound by driving a "voice coil" with an amplified version of the analog signal.

The DMA engine 128 may operate continuously, such that once the DMA engine 128 is finished with a first frame of audio data, the DMA engine 128 may request a second frame of audio data from the ping-pong buffer 226. For example, when the DMA engine 128 is finished with the first frame of audio data, the DMA engine 128 may generate an interrupt service routine (ISR) and send the ISR to the DSP 124 requesting the second frame of audio data.

The ISR indicates to the DSP 124 that the DMA engine 128 is ready to receive a second frame of audio data, which provides timing information associated with output generated by the speaker(s) 134. For example, as the rest of the audio pipeline is completely deterministic (e.g., audio samples are sequentially sent from the DMA engine 128 to the speaker(s) 134 for audio playback), the DSP 124 may determine a fixed delay from when an audio sample is output by the DMA engine 128 to when the audio sample is output by the speaker(s) 134. Thus, the DSP 124 may determine exactly when a first audio sample in the second frame will be output by the speaker(s) 134 based on the ISR. In addition, the DSP 124 previously detected the audio test signal within the second frame of audio data and determined a precise position of the audio test signal within the second frame of audio data (e.g., number of audio samples from a beginning of the second frame to the audio test signal). Therefore, the DSP 124 may determine exactly when the audio test signal will be output by the speaker(s) 134 based on the ISR and the precise position of the audio test signal within the second frame of audio data.

After receiving the ISR, the DSP 124 may generate a second timestamp (e.g., $\text{Timestamp}_{DSP}$) corresponding to a second time and may send the second timestamp to the time aligner 140. In some examples the second time corresponds to when the audio test signal will be output by the speaker(s) 134. For example, the DSP 134 may calculate the second time based on the ISR and the precise position of the audio test signal within the second frame. However, the disclosure is not limited thereto and the second time may instead correspond to when the ISR is received by the DSP 124. For example, the DSP 124 may send the second timestamp and position information of the audio test signal within the second frame to the time aligner 140 and the time aligner 140 may determine when the audio test signal will be output by the speaker(s) 134 without departing from the disclosure. Additionally or alternatively, the DSP 124 may send the position information (e.g., frame number and sample number within the frame associated with the audio test signal) and the DMA engine 128 may send the second timestamp in response to the ISR.

In the example illustrated in FIG. 2, the ARM processor 210 may operate using a first clock frequency and the DSP 220 may operate using a second clock frequency. Thus, the second timestamp generated by the DSP 124 may be associated with the second clock frequency and may need to be converted to the first clock frequency before the time aligner 140. Therefore, instead of sending the second timestamp directly to the time aligner 140, the DSP 124 may send the second timestamp to a timestamp converter 242. The timestamp converter 242 may translate the second timestamp associated with the DSP 220 (e.g., second clock frequency) to a third timestamp associated with the ARM 110 (e.g., first clock frequency). For example, the timestamp converter 242 may translate from a first value associated with the second clock frequency (e.g., the second timestamp) to a second value associated with the first clock frequency (e.g., the third timestamp).

The timestamp converter 242 may send the third timestamp and/or additional information to the time aligner 140. The timestamp converter 242 may be included in the DSP 220 and/or the ARM processor 110 without departing from the disclosure. In some examples, the timestamp converter 242 may determine when the audio test signal will be output by the speaker(s) 134 without departing from the disclosure. For example, the DSP 124 may send the position information (e.g., frame number and sample number within the frame associated with the audio test signal) to the timestamp converter 242 in response to detecting the audio test signal and the DMA engine 128 may send the second timestamp to the timestamp converter 242 in response to the ISR.

Audio placement may be performed by the time aligner 140, as discussed above. As the functionality of the time aligner 140 is identical between FIG. 1 and FIG. 2, a redundant description of the time aligner 140 is omitted from the description of FIG. 2.

Figure 3A:
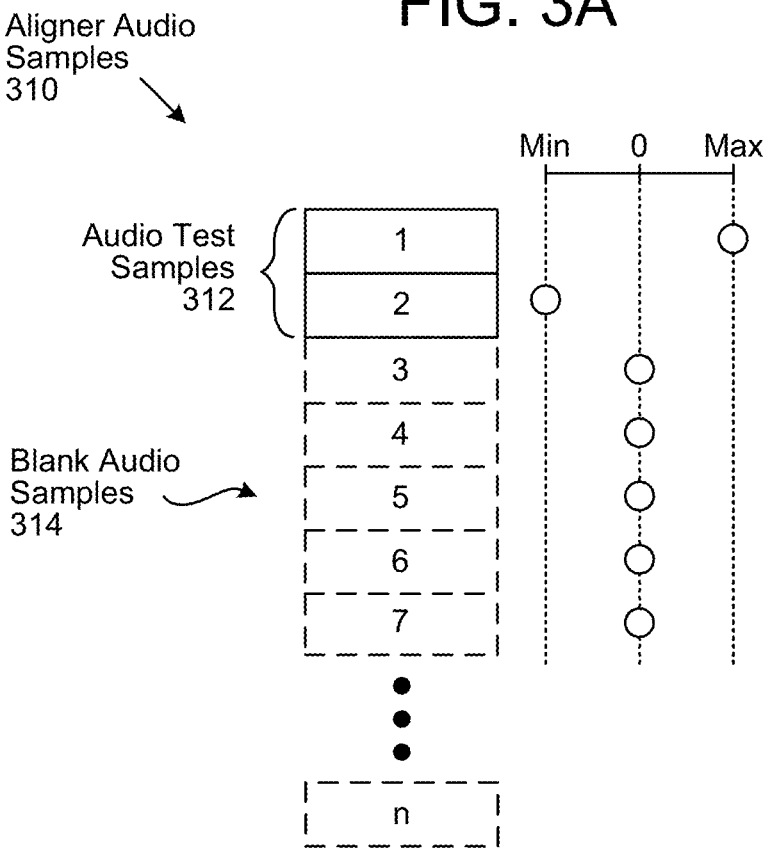
FIGS. 3A-3C illustrate examples of generating an audio test signal and detecting the audio test signal according to embodiments of the present disclosure.
Figure 3B:
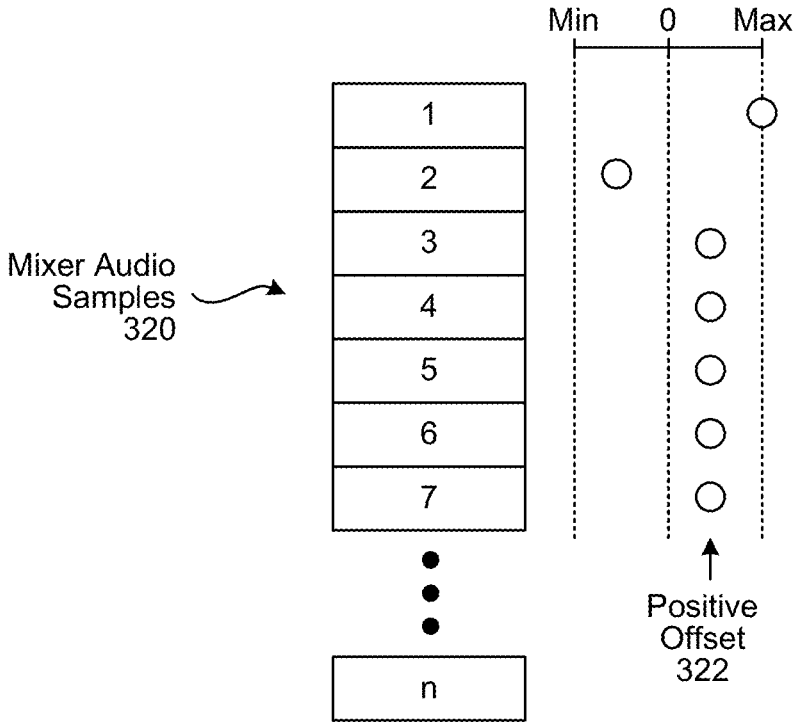
Figure 3C:
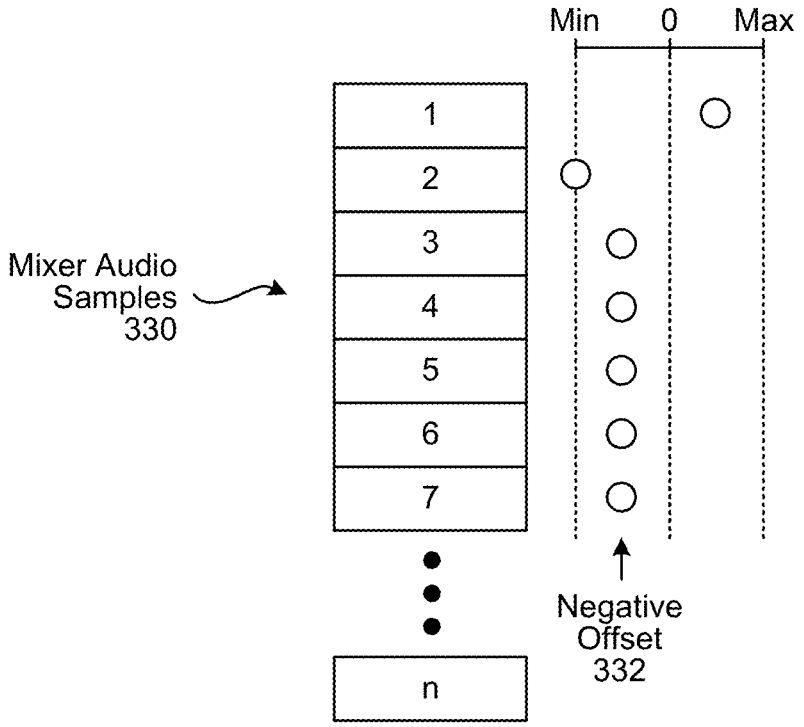

FIGS. 3A-3C illustrate examples of generating an audio test signal and detecting the audio test signal according to embodiments of the present disclosure. FIG. 3A illustrates an example of an output from the time aligner 140. As illustrated in FIG. 3A, the aligner audio samples 310 may comprise audio test samples 312, which include a first audio sample having a peak value of a maximum value (e.g., positive saturation threshold or the like) and a second audio sample having a peak value of a minimum value (e.g., negative saturation threshold or the like). Following the audio test samples 312 are a plurality of blank audio samples 314 that have an value of zero.

FIG. 3B illustrates an example of an output of the audio mixer 114 when the aligner audio samples 310 are combined with positive audio samples having a positive offset 322. As illustrated in FIG. 3B, the mixer audio samples 320 combine the aligner audio samples 310 illustrated in FIG. 3A with audio samples having the positive offset 322. The positive offset 322 shifts a value of audio samples 3 to n, which correspond to the blank audio samples 314, from zero to the positive offset 322, which is below the maximum value (e.g., positive saturation threshold). The positive offset 322 also shifts a value of the first audio sample, which corresponds to the first audio sample of the audio test samples 312, in a positive direction, which is still above the maximum value (e.g., positive saturation threshold). Finally, the positive offset 322 shifts a value of the second audio sample, which corresponds to the second audio sample of the audio test samples 312, above the minimum value (e.g., negative saturation threshold). Thus, a value of the second audio sample is above the negative saturation threshold and the DSP 124 may not detect the second audio sample as an audio test signal.

FIG. 3C illustrates an example of an output of the audio mixer 114 when the aligner audio samples 310 are combined with negative audio samples having a negative offset 332. As illustrated in FIG. 3C, the mixer audio samples 330 combine the aligner audio samples 310 illustrated in FIG. 3A with audio samples having the negative offset 332. The negative offset 332 shifts a value of audio samples 3 to n, which correspond to the blank audio samples 314, from zero to the negative offset 332, which is above the minimum value (e.g., negative saturation threshold). The negative offset 332 also shifts a value of the second audio sample, which corresponds to the second audio sample of the audio test samples 312, in a negative direction, which is still below the minimum value (e.g., negative saturation threshold). Finally, the negative offset 332 shifts a value of the first audio sample, which corresponds to the first audio sample of the audio test samples 312, below the maximum value (e.g., positive saturation threshold). Thus, a value of the first audio sample is below the positive saturation threshold and the DSP 124 may not detect the first audio sample as an audio test signal.

In the examples described herein, the audio test samples 312 includes the first audio sample and the second audio sample so that regardless of other audio samples combined with the audio test samples 312, the DSP 124 will detect at least one audio sample having a peak value exceeding the positive saturation threshold or below the negative saturation threshold. However, the disclosure is not limited thereto and the audio test signal may include the first audio sample and/or the second audio sample without departing from the disclosure. In some examples, the audio test samples 312 may include two or more of the first audio sample and/or two or more of the second audio sample without departing from the disclosure. For example, the audio test samples 312 may include a first audio sample having a peak value of a maximum value (e.g., positive saturation threshold), a second audio sample having a peak value of a minimum value (e.g., negative saturation threshold), a third audio sample having a peak value of the maximum value and a fourth audio sample having a peak value of the minimum value.

Figure 4A:
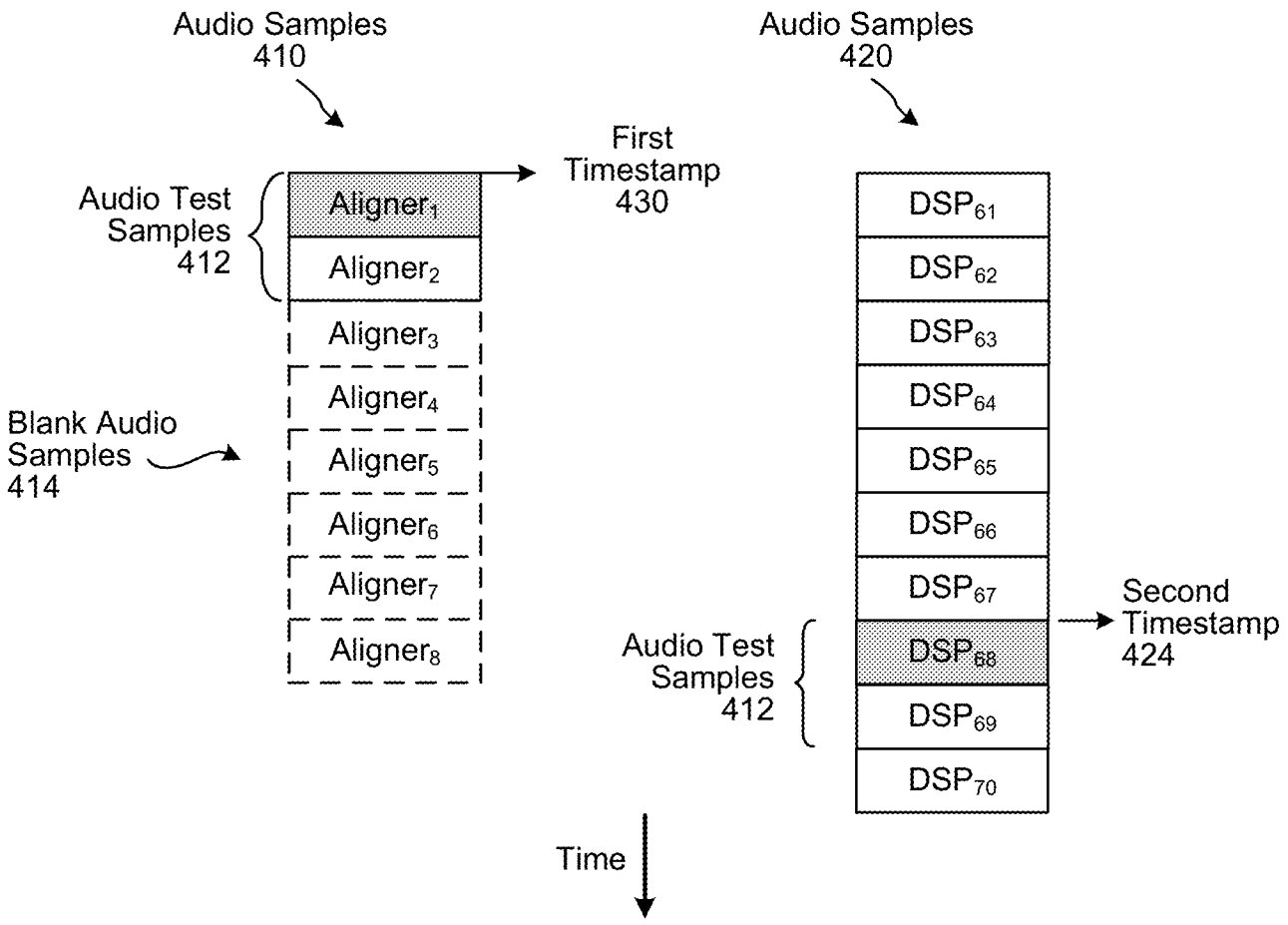
FIGS. 4A-4B illustrate examples of determining a playback delay and a number of audio samples in an audio pipeline according to embodiments of the present disclosure.
Figure 4B:
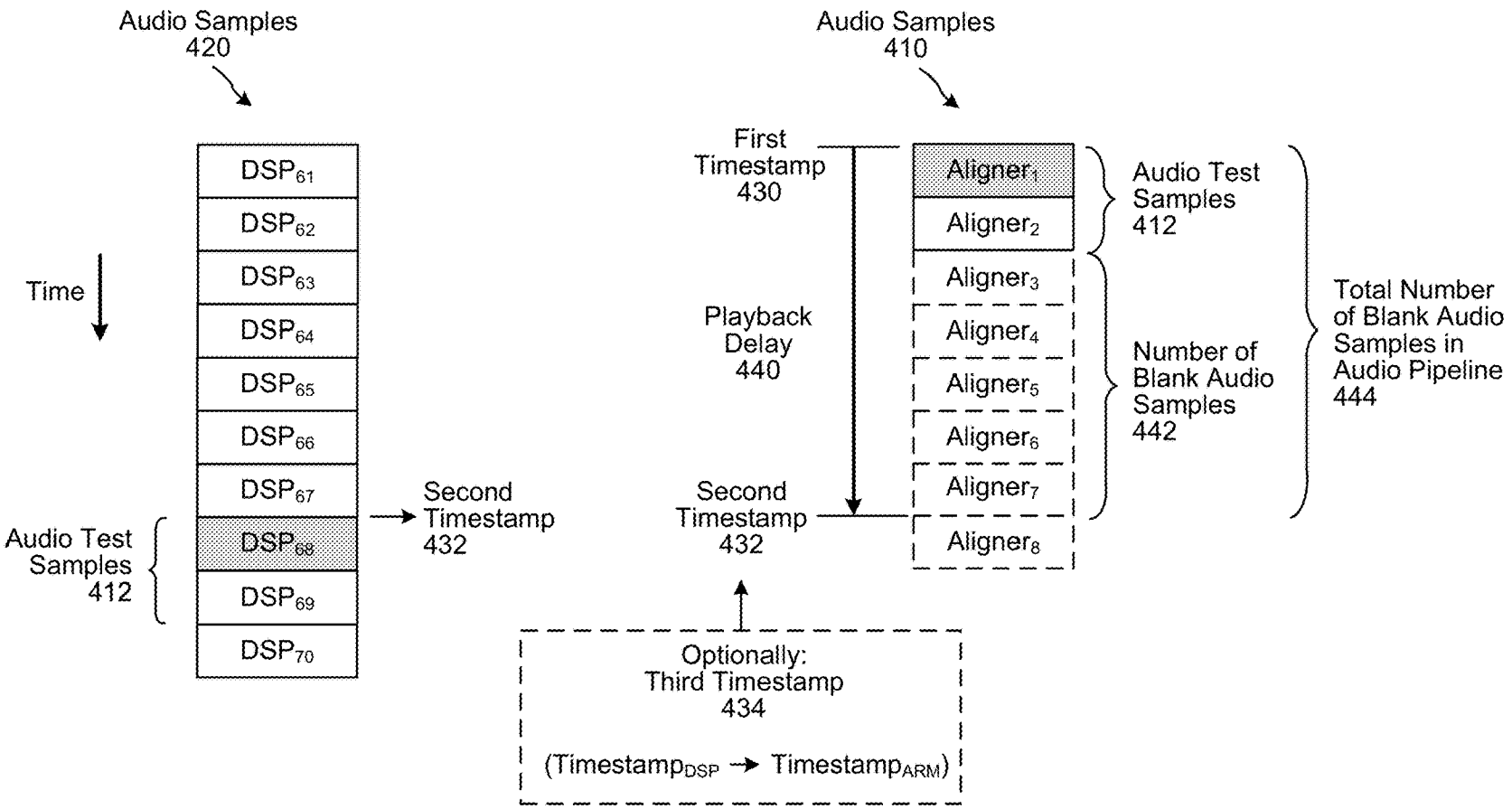

FIGS. 4A-4B illustrate examples of determining a playback delay and a number of audio samples in an audio pipeline according to embodiments of the present disclosure. As illustrated in FIG. 4A, audio samples 410 (e.g., audio samples $Aligner_1$-$Aligner_8$) may be generated by the time aligner 140 and may include audio test samples 412, which comprise a positive test audio sample (e.g., audio sample $Aligner_1$) having a value corresponding to the positive saturation threshold and a negative test audio sample (e.g., audio sample $Aligner_2$) having a value corresponding to the negative saturation threshold, followed by blank audio samples 414 (e.g., audio samples $Aligner_3$-$Aligner_8$).

The audio samples 410 may be output to the audio mixer 114 at a first time and the time aligner 140 may generate a first timestamp 430 corresponding to the first time. The audio mixer 114 may combine the audio samples 410 with other audio samples to generate audio samples 420 (e.g., audio samples $DSP_{61}$-$DSP_{70}$). Thus, audio sample $Aligner_1$ (e.g., the positive test audio sample) in the audio samples 410 corresponds to audio sample $DSP_{68}$ in the audio samples 420, as shown by the grey highlighting.

The DSP 124 may detect audio samples having a value greater than the positive saturation threshold or below the negative saturation threshold. Thus, the audio samples 420 may be output to the DSP 124 and the DSP 124 may detect that the audio sample $DSP_{68}$ has a value greater than the positive saturation threshold at a second time. The DSP 124 may generate a second timestamp 432 corresponding to the second time.

As illustrated in FIG. 4B, the second timestamp 432 may be sent to the time aligner 140 and the time aligner 140 may subtract the second timestamp 432 from the first timestamp 430 to determine a playback delay 440, which corresponds to a difference between the first time when the positive test audio sample (e.g., audio sample $Aligner_1$) was added to the audio pipeline and the second time when the positive test audio sample (e.g., audio sample $DSP_{68}$) was output by the audio pipeline. In some examples, the second timestamp 432 may be optionally converted to a third timestamp 434 and the third timestamp 434 may be sent to the time aligner 140. For example, the second timestamp 432 may be associated with a second clock frequency used by the DSP 220, whereas the third timestamp 434 may be associated with a first clock frequency used by the ARM processor 210. Thus, the timestamp converter 242 may convert the second timestamp 432 to the third timestamp 434 and the time aligner 140 may subtract the third timestamp 434 from the first timestamp 430 to determine the playback delay 440.

In addition to the playback delay 440, the time aligner 140 may determine the number of blank audio samples 442 (e.g., audio samples $Aligner_3$-$Aligner_7$) that were added to the audio pipeline between the first time and the second time. Thus, the time aligner 140 may determine that the playback delay 440 corresponded to the number of blank audio samples 442 (e.g., five blank audio samples) for a total number of audio samples in the audio pipeline 444 (e.g., seven audio samples) when including the audio test samples 412. Based on the playback delay 440 and the total number of audio samples in the pipeline 444, the time aligner 140 may add audio samples (e.g., blank audio samples having a value of zero) to the audio pipeline in order to delay the next audio sample or may skip audio samples (e.g., remove audio samples from the audio pipeline) in order to play the next audio sample sooner, as discussed in greater detail above. Thus, the device 102 may add audio samples or skip audio samples so that the next audio sample added to the audio pipeline is output by the speaker(s) 134 at a specific time.

Figure 5A:
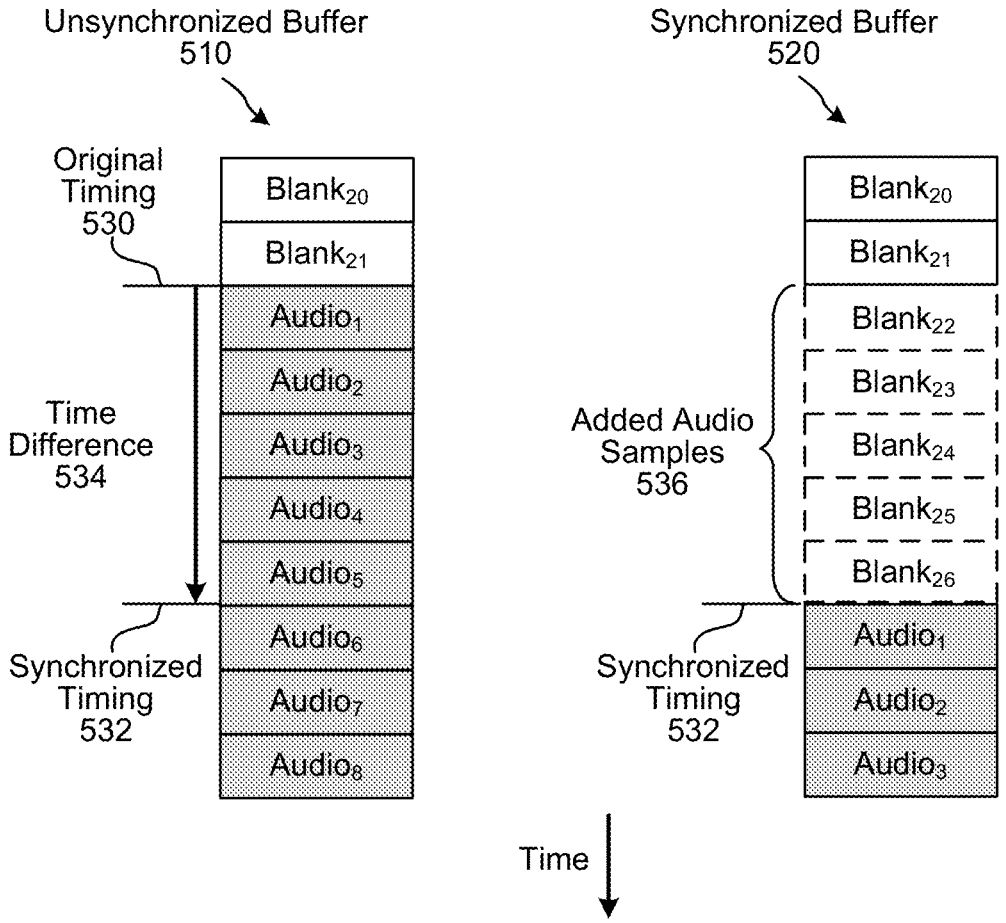
FIGS. 5A-5B illustrate examples of performing audio placement by adding or skipping audio samples according to embodiments of the present disclosure.
Figure 5B:
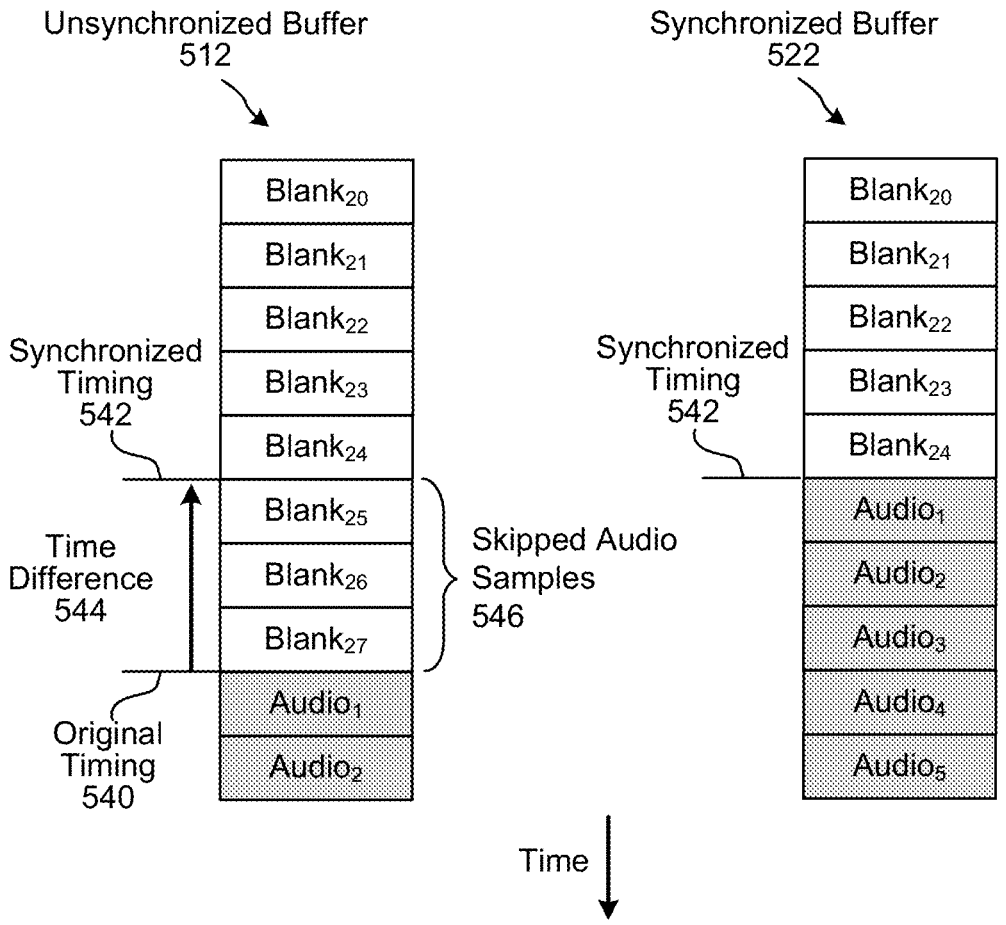

FIGS. 5A-5B illustrate examples of performing audio placement by adding or skipping audio samples according to embodiments of the present disclosure. Based on the playback delay and the number of audio samples in the audio pipeline, the device 102 may add audio samples (e.g., blank audio samples having a value of zero) to the audio pipeline in order to delay the next audio sample, as illustrated in FIG. 5A, or may skip audio samples (e.g., remove audio samples from the audio pipeline) in order to play the next audio sample sooner, as illustrated in FIG. 5B. Thus, the device 102 may add audio samples or skip audio samples so that the next audio sample added to the audio pipeline is output by the speaker(s) 134 at a specific time.

As illustrated in FIG. 3A, the device 102 may add blank audio samples in order to delay a first audio sample (e.g., $Audio_1$) in audio data (e.g., a beginning of a song). For example, an unsynchronized buffer 510 (e.g., audio buffer 116 prior to adding audio samples) may include a number of audio samples corresponding to blank audio samples (e.g., $Blank_{20}$-$Blank_{21}$) and a portion of the audio data (e.g., $Audio_1$-$Audio_8$). Based on the current number of audio samples included in the unsynchronized buffer 510, the first audio sample of the audio data (e.g., $Audio_1$) would be output by the speaker(s) 134 based on original timing 530. However, the device 102 may want to delay the first audio sample such that the first audio sample is output by the speaker(s) 134 at synchronized timing 532.

In order to precisely output the first audio sample (e.g., $Audio_1$) of the audio data, the device 102 may determine a time difference 534 between the original timing 530 and the synchronized timing 532 and determine a number of audio samples corresponding to the time difference 534. For example, the device 102 may determine that the time difference 534 corresponds to added audio samples 536, which are included in the synchronized buffer 520 (e.g., audio buffer 116 after adding the audio samples). Thus, the device 102 may output the original blank audio samples ($Blank_{20}$-$Blank_{21}$), followed by five blank added audio samples 536 ($Blank_{22}$-$Blank_{26}$) and then output the first audio sample (e.g., $Audio_1$) of the audio data, which is output at the synchronized timing 532. While this example illustrates the device 102 adding blank audio samples, the disclosure is not limited thereto and the device 102 may add any type of audio samples without departing from the disclosure. For example, the device 102 may duplicate an audio sample and/or may output audio samples having values other than zero without departing from the disclosure.

As illustrated in FIG. 5B, the device 102 may skip audio samples in order to reduce a delay associated with outputting the first audio sample (e.g., $Audio_1$) of the audio data. For example, an unsynchronized buffer 512 (e.g., audio buffer 116 prior to removing audio samples) may include a number of audio samples corresponding to blank audio samples (e.g., $Blank_{20}$-$Blank_{27}$) and a portion of the audio data (e.g., $Audio_1$-$Audio_2$). Based on the current number of audio samples included in the unsynchronized buffer 512, the first audio sample (e.g., $Audio_1$) would be output by the speaker(s) 134 based on original timing 540. However, the device 102 may want to output the first audio sample sooner such that the first audio sample is output by the speaker(s) 134 at synchronized timing 542.

In order to precisely output the first audio sample, the device 102 may determine a time difference 544 between the original timing 540 and the synchronized timing 542 and determine a number of audio samples corresponding to the time difference 544. For example, the device 102 may determine that the time difference 544 corresponds to skipped audio samples 546 (e.g., $Blank_{25}$-$Blank_{27}$)), which are removed from the synchronized buffer 522 (e.g., audio buffer 116 after removing the audio samples). Thus, the device 102 may output the blank audio samples (e.g., $Blank_{20}$-$Blank_{24}$), followed by the first audio sample (e.g., $Audio_1$) of the audio data, which is output at the synchronized timing 542.

Figure 6A:
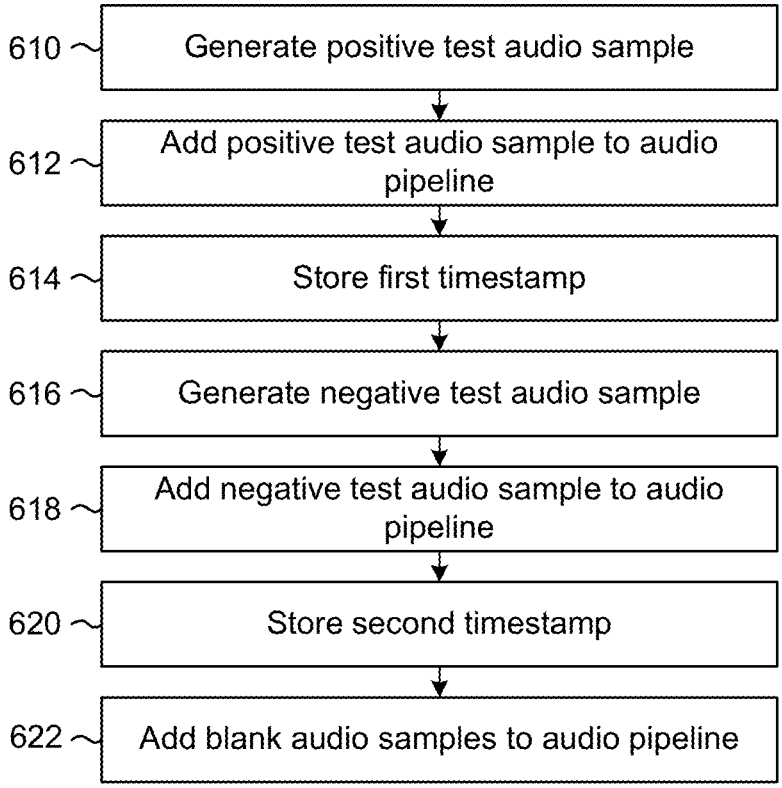
FIGS. 6A-6D are flowcharts conceptually illustrating example methods for determining a playback delay and a number of audio samples in an audio pipeline according to embodiments of the present disclosure.

FIGS. 6A-6D are flowcharts conceptually illustrating example methods for determining a playback delay and a number of audio samples in an audio pipeline according to embodiments of the present disclosure. As illustrated in FIG. 6A, the time aligner 140 may generate (610) a positive test audio sample, may add (612) the positive test audio sample to the audio pipeline, and may store (614) a first timestamp corresponding to when the positive test audio sample was added to the audio pipeline. The time aligner 140 may generate (616) a negative test audio sample, may add (618) the negative test audio sample to the audio pipeline and may store (620) a second timestamp corresponding to when the negative test audio sample was added to the audio pipeline. The time aligner 140 may add (622) blank audio samples to the audio pipeline.

Figure 6B:
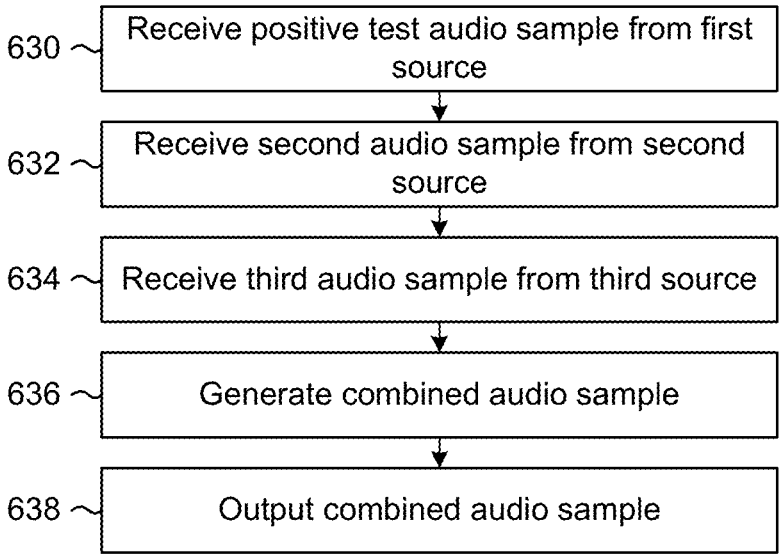

As illustrated in FIG. 6B, the audio mixer 114 may receive (630) the positive test audio sample from a first source (e.g., media player 112*c*), may receive (632) a second audio sample from a second source (e.g., TTS player 112*b*) and may receive (634) a third audio sample from a third source (e.g., notification player 112*a*). The audio mixer 114 may generate (636) a combined audio sample based on the positive test audio sample, the second audio sample and the third audio sample, and may output (638) the combined audio sample to the DSP 124.

Figure 6C:
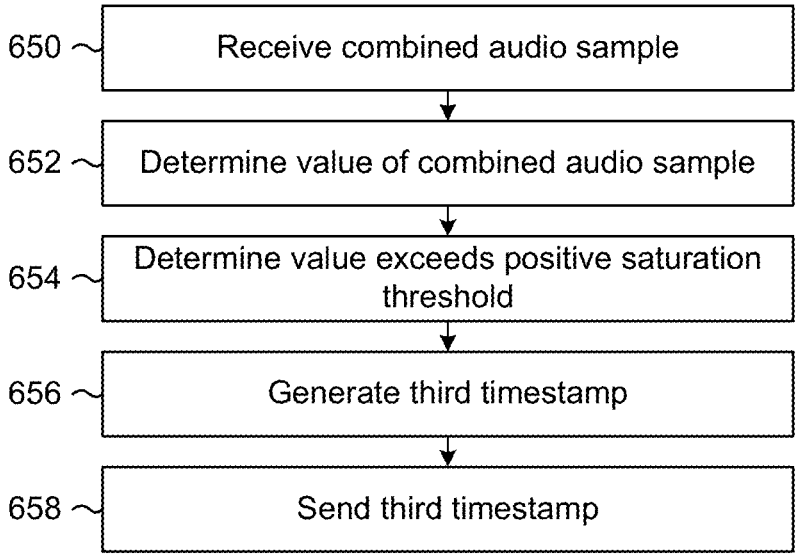

As illustrated in FIG. 6C, the DSP 124 may receive (650) the combined audio sample, may determine (652) a value of the combined audio sample, and may determine (654) that the value exceeds a positive saturation threshold. The DSP 124 may generate (656) a third timestamp corresponding to the value exceeding the positive saturation threshold and may send (658) the third timestamp to the time aligner 140. For example, as discussed in greater detail above, the DSP 124 may generate the second timestamp based on when the positive audio test signal is input to the DMA engine 128 and/or will be output by the speaker(s) 134.

Figure 6D:
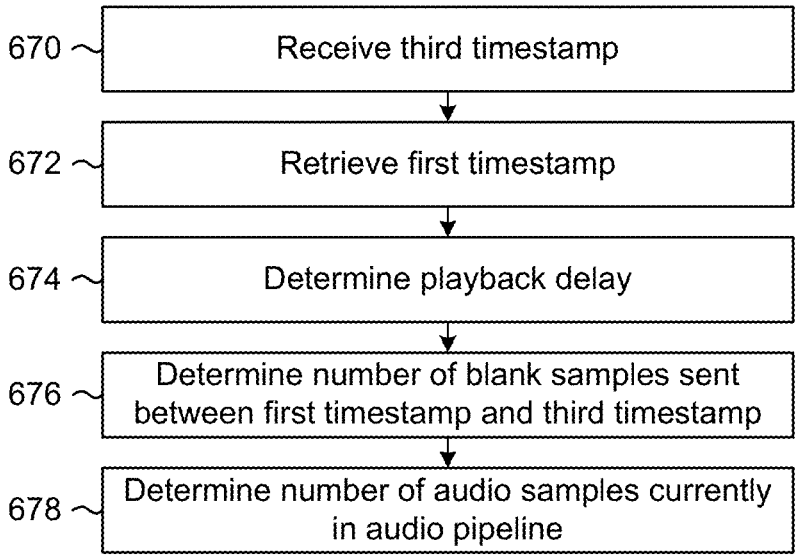

As illustrated in FIG. 6D, the time aligner 140 may receive (670) the third timestamp, may retrieve (672) the first timestamp and determine (674) a playback delay by subtracting the third timestamp from the first timestamp. The time aligner 140 may determine (676) a number of blank samples sent between the first timestamp and the third timestamp and may determine (678) a number of audio samples currently in the audio pipeline.

Figure 7A:
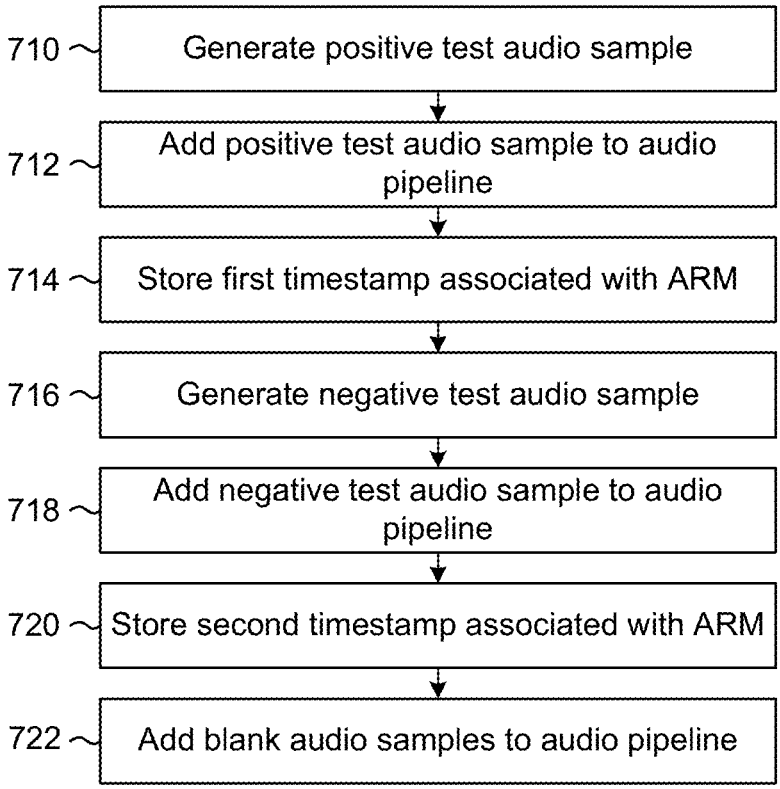
FIGS. 7A-7D are flowcharts conceptually illustrating example methods for determining a playback delay and a number of audio samples in an audio pipeline according to embodiments of the present disclosure.

FIGS. 7A-7D are flowcharts conceptually illustrating example methods for determining a playback delay and a number of audio samples in an audio pipeline according to embodiments of the present disclosure. As illustrated in FIG. 7A, the time aligner 140 may generate (710) a positive test audio sample, may add (712) the positive test audio sample to the audio pipeline, and may store (714) a first timestamp associated with the ARM processor 210. The time aligner 140 may generate (716) a negative test audio sample, may add (718) the negative test audio sample to the audio pipeline and may store (720) a second timestamp associated with the ARM processor 210. The time aligner 140 may add (722) blank audio samples to the audio pipeline.

Figure 7B:
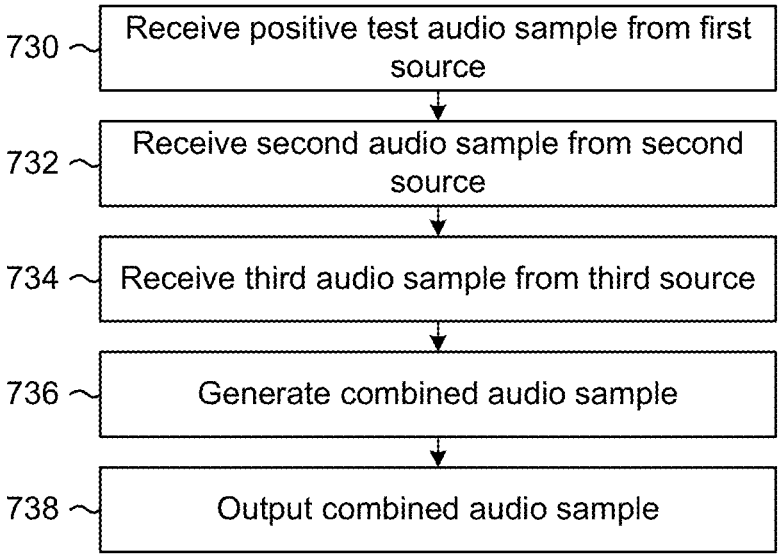

As illustrated in FIG. 7B, the audio mixer 114 may receive (730) the positive test audio sample from a first source (e.g., media player 112*c*), may receive (732) a second audio sample from a second source (e.g., TTS player 112*b*) and may receive (734) a third audio sample from a third source (e.g., notification player 112*a*). The audio mixer 114 may generate (736) a combined audio sample based on the positive test audio sample, the second audio sample and the third audio sample, and may output (738) the combined audio sample to the DSP 220.

Figure 7C:
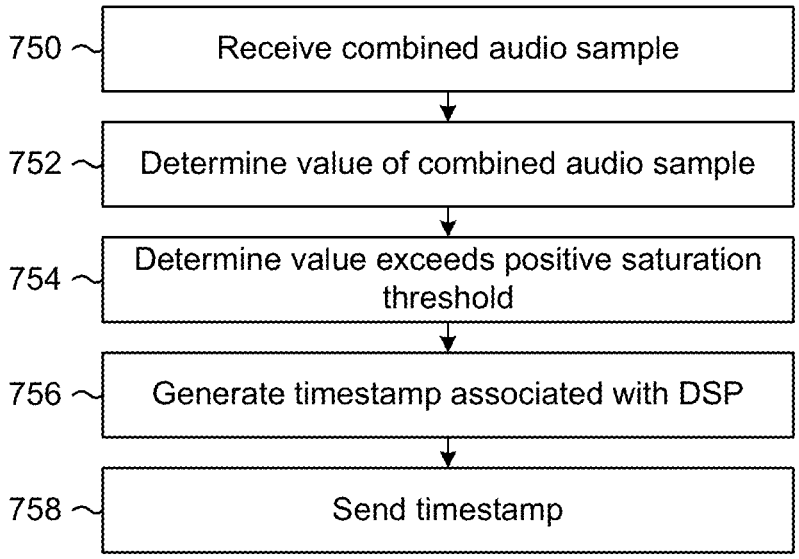

As illustrated in FIG. 7C, the DSP 220 may receive (750) the combined audio sample, may determine (752) a value of the combined audio sample, and may determine (754) that the value exceeds a positive saturation threshold. The DSP 220 may generate (756) a timestamp associated with the DSP 220 and may send (758) the timestamp to the timestamp converter 242.

Figure 7D:
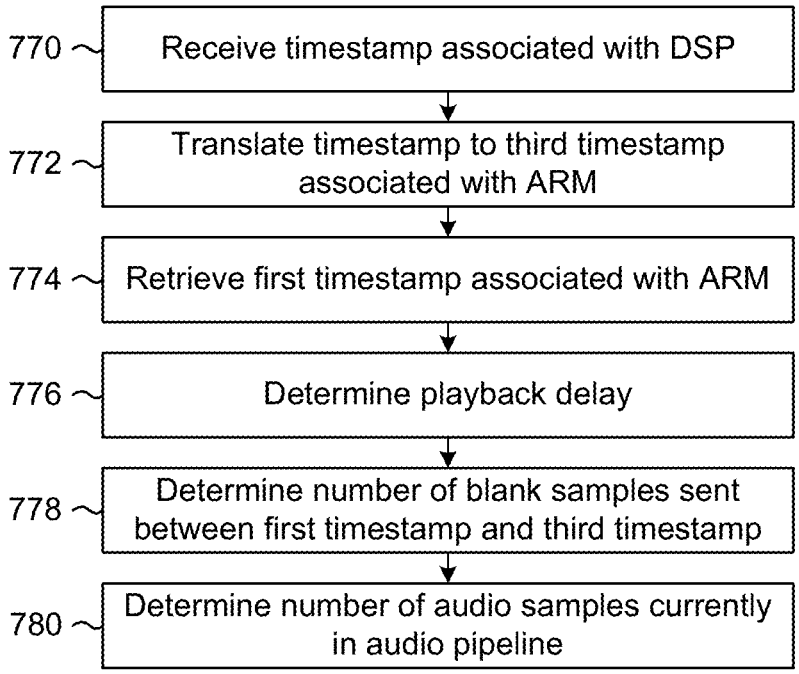

As illustrated in FIG. 7D, the ARM processor 210 may receive (770) the timestamp associated with the DSP 220 and may translate (772) the timestamp to a third timestamp associated with the ARM processor 210. The ARM processor 210 may retrieve (774) the first timestamp associated with the ARM processor 210 and determine (776) a playback delay by subtracting the third timestamp from the first timestamp. The ARM processor 210 may determine (778) a number of blank samples sent between the first timestamp and the third timestamp and may determine (780) a number of audio samples currently in the audio pipeline.

Figure 8:
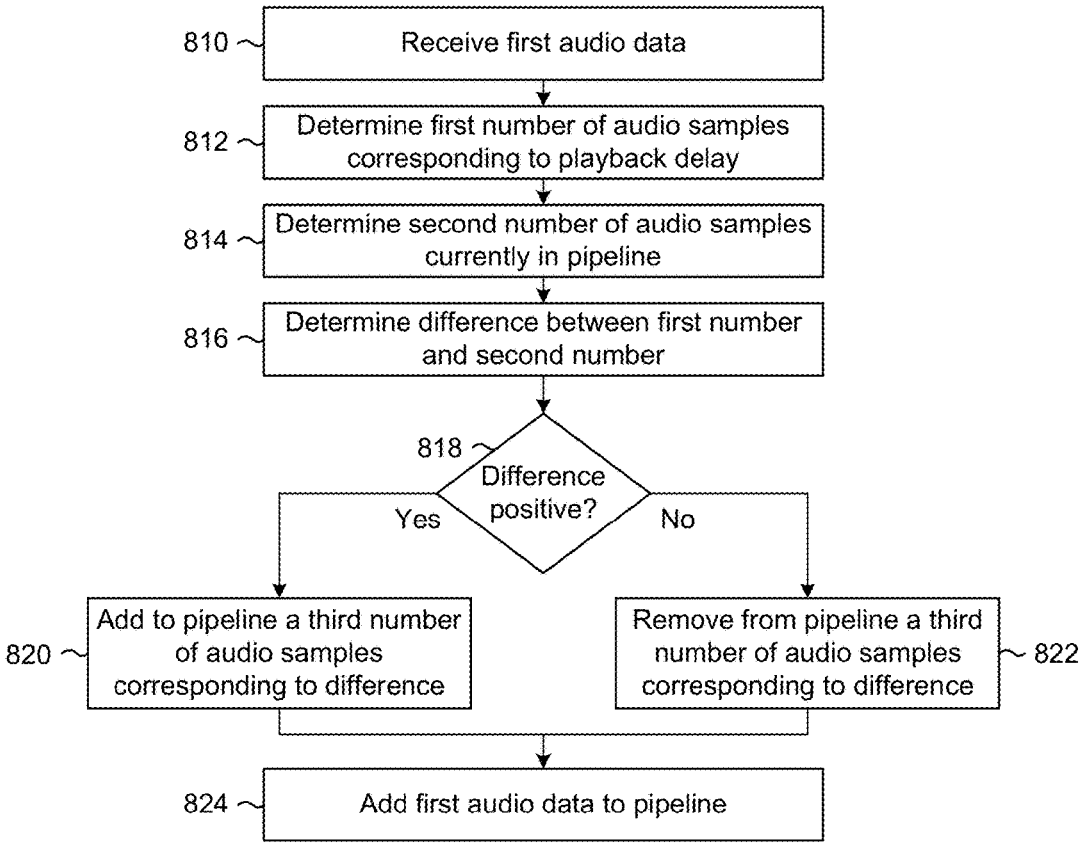
FIG. 8 is a flowchart conceptually illustrating an example method for performing audio placement according to embodiments of the present disclosure.

FIG. 8 is a flowchart conceptually illustrating an example method for performing audio placement according to embodiments of the present disclosure. As illustrated in FIG. 8, the time aligner 140 may receive (810) first audio data from the media player 112*c*, may determine (812) a first number of audio samples corresponding to the playback delay and determine (814) a second number of audio samples currently in the pipeline.

The time aligner 140 may determine (816) a difference between the first number and the second number and may determine (818) whether the difference is positive. If the difference is positive, the time aligner 140 may add (820) to the audio pipeline a third number of audio samples corresponding to the difference. If the difference is negative, the time aligner may remove (820) from the audio pipeline the third number of audio samples corresponding to the difference. The time aligner 140 may then add (824) the first audio data to the audio pipeline. Thus, the device 102 may add or remove audio samples from the audio pipeline so that a first audio sample of the first audio data is output by the speaker(s) 134 at a specific time.

Figure 9:
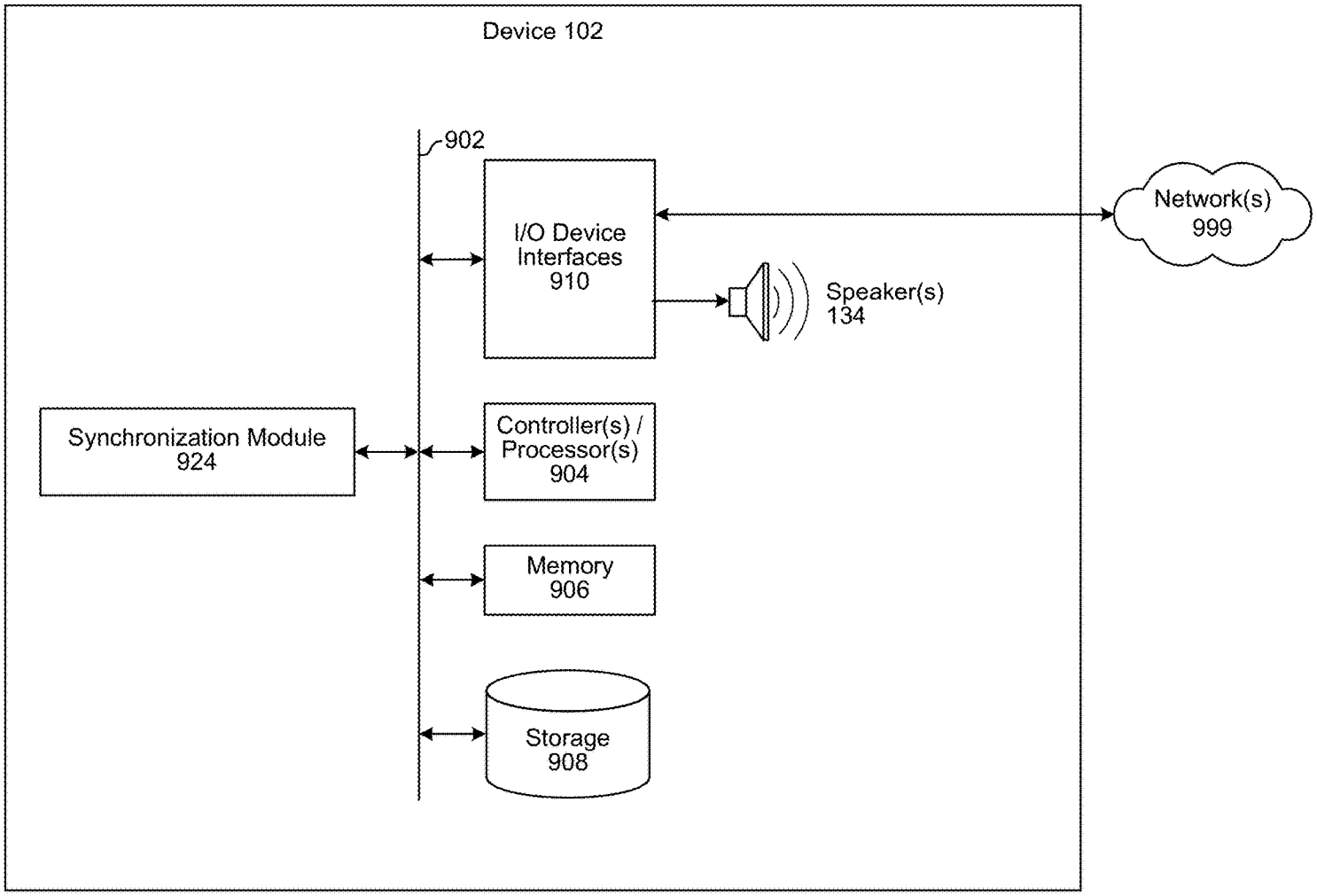
FIG. 9 is a block diagram conceptually illustrating example components of a system 100 configured to perform audio placement according to embodiments of the present disclosure.

FIG. 9 is a block diagram conceptually illustrating example components of a system 100 configured to perform audio placement according to embodiments of the present disclosure. In operation, the system 100 may include computer-readable and computer-executable instructions that reside on the device 102, as will be discussed further below.

The device 102 may include an audio output device for producing sound, such as speaker(s) 134, and the audio output device may be integrated into the device 102 or may be separate. The device 102 may be an electronic device capable of receiving audio data and outputting the audio data using precise timing. For example, the device 102 may output the audio data in synchronization with audio data output by other speaker(s) and/or device(s). Examples of electronic devices may include computers (e.g., a desktop, a laptop, a server or the like), portable devices (e.g., smart phone, tablet, speech controlled devices or the like), media devices (e.g., televisions, video game consoles, or the like), or the like. The device 102 may also be a component of any of the abovementioned devices or systems.

As illustrated in FIG. 9, the device 102 may include an address/data bus 902 for conveying data among components of the device 102. Each component within the device 102 may also be directly connected to other components in addition to (or instead of) being connected to other components across the bus 902.

The device 102 may include one or more controllers/processors 904, that may each include a central processing unit (CPU) for processing data and computer-readable instructions, and a memory 906 for storing data and instructions. The memory 906 may include volatile random access memory (RAM), non-volatile read only memory (ROM), non-volatile magnetoresistive (MRAM) and/or other types of memory. The device 102 may also include a data storage component 908, for storing data and controller/processor-executable instructions (e.g., instructions to perform the algorithms illustrated in FIGS. 1, 6A-6D, 7A-7D and/or 8). The data storage component 908 may include one or more non-volatile storage types such as magnetic storage, optical storage, solid-state storage, etc. The device 102 may also be connected to removable or external non-volatile memory and/or storage (such as a removable memory card, memory key drive, networked storage, etc.) through the input/output device interfaces 910.

The device 102 includes input/output device interfaces 910. A variety of components may be connected through the input/output device interfaces 910, such as the speaker 134, microphone(s) (not illustrated), wireless speaker(s) (not illustrated) or the like. The input/output interfaces 910 may include digital to analog (D/A) converters for converting audio signals into an analog current to drive the speaker(s) 134, if the speaker(s) 134 are integrated with or hardwired to the device 102. However, if the speaker(s) 134 are independent, the D/A converters will be included with the speaker(s) 134, and may be clocked independent of the clocking of the device 102 (e.g., conventional Bluetooth speakers). Likewise, the input/output interfaces 910 may include analog to digital (A/D) converters for converting output of the microphone(s) into digital signals if the microphones are integrated with or hardwired directly to the device 102. If the microphone(s) are independent, the A/D converters will be included with the microphone(s), and may be clocked independent of the clocking of the device 102.

The input/output device interfaces 910 may also include an interface for an external peripheral device connection such as universal serial bus (USB), FireWire, Thunderbolt or other connection protocol. The input/output device interfaces 910 may also be configured to operate with to one or more network(s) 999 via an Ethernet port, a wireless local area network (WLAN) (such as WiFi) radio, Bluetooth, and/or wireless network radio, such as a radio capable of communication with a wireless communication network such as a Long Term Evolution (LTE) network, WiMAX network, 3G network, etc. The network(s) 999 may include a local or private network or may include a wide network such as the internet. Through the network(s) 999, the system 100 may be distributed across a networked environment.

The device 102 further includes a synchronization module 924, which may comprise processor-executable instructions stored in storage 908 to be executed by controller(s)/processor(s) 904 (e.g., software, firmware, hardware, or some combination thereof). For example, components of the synchronization module 924 may be part of a software application running in the foreground and/or background on the device 102. The synchronization module 924 may control the device 102 as discussed above, for example with regard to FIGS. 1, 6A-6D, 7A-7D and/or 8. Some or all of the controllers/modules of the synchronization module 924 may be executable instructions that may be embedded in hardware or firmware in addition to, or instead of, software. In one embodiment, the device 102 may operate using an Android operating system (such as Android 4.3 Jelly Bean, Android 4.4 KitKat or the like), an Amazon operating system (such as FireOS or the like), or any other suitable operating system.

Executable computer instructions for operating the device 102 and its various components may be executed by the controller(s)/processor(s) 904, using the memory 906 as temporary "working" storage at runtime. The computer instructions may be stored in a non-transitory manner in non-volatile memory 906, storage 908, or an external device. Alternatively, some or all of the executable instructions may be embedded in hardware or firmware in addition to or instead of software.

The components of the device 102, as illustrated in FIG. 9, are exemplary, and may be located a stand-alone device or may be included, in whole or in part, as a component of a larger device or system. Additionally or alternatively, multiple devices 102 may be employed in a single system 100, and the multiple devices 102 may include overlapping components. For example, in certain system configurations, a first device may transmit the audio data to a second device and/or a third device, and the second device and/or the third device may output the audio data at approximately the same time, such that the audio data is synchronized between the second device and the third device.

The concepts disclosed herein may be applied within a number of different devices and computer systems, including, for example, general-purpose computing systems, server-client computing systems, mainframe computing systems, telephone computing systems, laptop computers, cellular phones, personal digital assistants (PDAs), tablet computers, video capturing devices, video game consoles, speech processing systems, distributed computing environments, etc. Thus the modules, components and/or processes described above may be combined or rearranged without departing from the scope of the present disclosure. The functionality of any module described above may be allocated among multiple modules, or combined with a different module. As discussed above, any or all of the modules may be embodied in one or more general-purpose microprocessors, or in one or more special-purpose digital signal processors or other dedicated microprocessing hardware. One or more modules may also be embodied in software implemented by a processing unit. Further, one or more of the modules may be omitted from the processes entirely.

The above embodiments of the present disclosure are meant to be illustrative. They were chosen to explain the principles and application of the disclosure and are not intended to be exhaustive or to limit the disclosure. Many modifications and variations of the disclosed embodiments may be apparent to those of skill in the art. Persons having ordinary skill in the field of computers and/or digital imaging should recognize that components and process steps described herein may be interchangeable with other components or steps, or combinations of components or steps, and still achieve the benefits and advantages of the present disclosure. Moreover, it should be apparent to one skilled in the art, that the disclosure may be practiced without some or all of the specific details and steps disclosed herein.

Embodiments of the disclosed system may be implemented as a computer method or as an article of manufacture such as a memory device or non-transitory computer readable storage medium. The computer readable storage medium may be readable by a computer and may comprise instructions for causing a computer or other device to perform processes described in the present disclosure. The computer readable storage medium may be implemented by a volatile computer memory, non-volatile computer memory, hard drive, solid-state memory, flash drive, removable disk and/or other media.

Embodiments of the present disclosure may be performed in different forms of software, firmware and/or hardware. Further, the teachings of the disclosure may be performed by an application specific integrated circuit (ASIC), field programmable gate array (FPGA), or other component, for example.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without author input or prompting, whether these features, elements and/or steps are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

Conjunctive language such as the phrase "at least one of X, Y and Z," unless specifically stated otherwise, is to be understood with the context as used in general to convey that an item, term, etc. may be either X, Y, or Z, or a combination thereof. Thus, such conjunctive language is not generally intended to imply that certain embodiments require at least one of X, at least one of Y and at least one of Z to each is present.

As used in this disclosure, the term "a" or "one" may include one or more items unless specifically stated otherwise. Further, the phrase "based on" is intended to mean "based at least in part on" unless specifically stated otherwise.

What is claimed is:

1. A computer-implemented method, the method comprising:

generating an audio test signal comprising a first audio sample having a positive peak value equal to or above a first saturation threshold and a second audio sample having a negative peak value equal to or below a second saturation threshold;

adding, by a main processor at a first time, the audio test signal to an audio pipeline to be output by a loudspeaker, the main processor included in the loudspeaker;

generating one or more blank audio samples;

adding the one or more blank audio samples to the audio pipeline;

detecting, by a digital signal processor at a second time, the audio test signal at an output of the audio pipeline by detecting a third audio sample having a peak value above the first saturation threshold or below the second saturation threshold, the digital signal processor included in the loudspeaker;

determining, by the main processor, a playback delay equal to a first difference between the first time and the second time;

determining, by the main processor, a number of the one or more blank audio samples added to the audio pipeline between the first time and the second time;

determining a start time associated with an output audio sample, the output audio sample corresponding to a beginning of audio data;

synchronizing the audio pipeline to the start time, the synchronizing comprising one of:

adding at least one additional blank audio sample to the audio pipeline, the at least one additional blank audio sample being in addition to the one or more blank audio samples, or removing at least one of the one or more blank audio samples from the audio pipeline; and adding the output audio sample to the audio pipeline.

2. The computer-implemented method of claim 1, further comprising, by the main processor:

receiving the output audio sample;

determining a second difference between a current time and the start time;

determining a first number of audio samples corresponding to the second difference, each of the audio samples having a fixed duration;

determining a second number of audio samples currently in the audio pipeline, the second number of audio samples equal to a sum of the number of the one or more blank audio samples and a third number of audio samples included in the audio test signal;

determining that the first number of audio samples is greater than the second number of audio samples;

adding the at least one additional blank audio sample to the audio pipeline; and adding the output audio sample to the audio pipeline such that the loudspeaker outputs the output audio sample at the start time.

3. The computer-implemented method of claim 1, further comprising, by the main processor:

receiving the output audio sample;

determining a second difference between a current time and the start time;

determining a first number of audio samples corresponding to the second difference, each of the audio samples having a fixed duration;

determining a second number of audio samples currently in the audio pipeline, the second number of audio samples equal to a sum of the number of the one or more blank audio samples and a third number of audio samples included in the audio test signal;

determining that the first number of audio samples is less than the second number of audio samples;

removing the at least one of the one or more blank audio samples from the audio pipeline; and adding the output audio sample to the audio pipeline such that the loudspeaker outputs the output audio sample at the start time.

4. The computer-implemented method of claim 1, further comprising:

determining a timer offset between a first timer associated with the main processor and a second timer associated with the digital signal processor;

determining, using the first timer, a first timestamp value corresponding to the first time;

determining, using the second timer, a second timestamp value corresponding to the second time;

determining, by summing the second timestamp value and the timer offset, a third timestamp value corresponding to the second time and associated with the first timer; and determining the playback delay by subtracting the third timestamp value from the second timestamp value.

5. A computer-implemented method, comprising:

sending, by a first component of a device to a second component of the device at a first time, an audio test signal, the audio test signal comprising at least a first audio sample having a positive peak value equal to or above a first threshold value and a second audio sample having a negative peak value equal to or below a second threshold value;

sending, by the first component to the second component after the first time, one or more audio samples;

detecting, by the second component at a second time, the audio test signal by detecting a third audio sample having a peak value above the first threshold value or below the second threshold value;

determining, by the second component, a timestamp value corresponding to the second time;

sending, by the second component to the first component, the timestamp value;

determining, by the first component based on the timestamp value, a first number of the one or more audio samples sent between the first time and the second time;

determining a second number of audio samples in an audio pipeline based on the first number of the one or more audio samples and a third number of audio samples included in the audio test signal;

determining, by the first component, a third time at which to output a fourth audio sample, the fourth audio sample corresponding to a beginning of audio data;

synchronizing, by the first component, the audio pipeline to the third time by adding at least one audio sample to the audio pipeline; and adding, by the first component, the fourth audio sample to the audio pipeline.

6. The computer-implemented method of claim 5, further comprising:

generating the first audio sample;

generating the second audio sample;

generating a fifth audio sample having a positive peak value equal to or above the first threshold value; and generating the audio test signal including the first audio sample, the second audio sample and the fifth audio sample.

7. The computer-implemented method of claim 5, wherein:

determining the third time at which to output the fourth audio sample further comprises:

receiving the audio data including the fourth audio sample; and receiving an indication of the third time at which to output the fourth audio sample, and synchronizing the audio pipeline further comprises:

determining a time difference between a current time and the third time;

determining a fourth number of audio samples corresponding to the time difference;

determining a fifth number of audio samples currently in the audio pipeline to be output by a loudspeaker;

determining that the fourth number of audio samples is greater than the fifth number of audio samples; and adding the at least one audio sample to the audio pipeline.

8. The computer-implemented method of claim 5, further comprising:

receiving first audio data;

determining a frequency offset between the first component and a third component on a separate device;

generating second audio data using the first audio data by one of:

removing at least one sample of the first audio data per cycle based on the frequency offset, adding a duplicate copy of at least one sample of the first audio data to the first audio data per cycle based on the frequency offset, or interpolating between adjacent samples of the first audio data to either add or delete samples fractionally;

sending the second audio data to a loudspeaker.

9. The computer-implemented method of claim 5, further comprising:

receiving, by an audio mixer, the first audio sample having the positive peak value;

receiving, by the audio mixer, a fifth audio sample having a second peak value;

determining a sum of the positive peak value and the second peak value;

determining that the sum exceeds a saturation threshold;

generating a sixth audio sample, a peak value of the sixth audio sample corresponding to the saturation threshold; and sending the sixth audio sample to the second component instead of the first audio sample.

10. The computer-implemented method of claim 5, further comprising:

determining a timer offset between a first timer associated with the first component and a second timer associated with the second component;

determining, using the first timer, a second timestamp value corresponding to the first time;

determining, using the second timer, the timestamp value corresponding to the second time;

determining, based on the timestamp value and the timer offset, a third timestamp value corresponding to the second time and associated with the first timer; and determining a playback delay value by subtracting the third timestamp value from the second timestamp value.

11. The computer-implemented method of claim 5, wherein the first component and the second component are included in a loudspeaker.

12. The computer-implemented method of claim 5, wherein the first threshold value is a positive saturation threshold and the second threshold value is a negative saturation threshold.

13. The computer-implemented method of claim 5, wherein the first audio sample is adjacent to the second audio sample in the audio test signal.

14. A device, comprising:

at least one processor, including a first component and a second component; and memory including instructions operable to be executed by the at least one processor to perform a set of actions to cause the device to:

send, by the first component to the second component at a first time, an audio test signal, the audio test signal comprising at least a first audio sample having a positive peak value equal to or above a first threshold value and a second audio sample having a negative peak value equal to or below a second threshold value;

detect, by the second component at a second time, the audio test signal at an output of the audio pipeline by detecting a third audio sample having a peak value above the first threshold value or below the second threshold value;

determine, by the second component, a timestamp value corresponding to the second time;

send, by the second component to the first component, the timestamp value;

determine, by the first component based on the timestamp value, a playback delay corresponding to a first difference between the first time and the second time;

determine, by the first component, a third time at which to output a fourth audio sample, the fourth audio sample corresponding to a beginning of audio data;

determine a second difference between a current time and the third time;

determine a first number of audio samples corresponding to the second difference;

determine a second number of audio samples currently in an audio pipeline to be output by a loudspeaker;

determine that the first number of audio samples is greater than the second number of audio samples;

synchronize, by the first component, the audio pipeline to the third time by removing at least one audio sample from the audio pipeline; and add, by the first component, the fourth audio sample to the audio pipeline.

15. The device of claim 14, wherein the memory further comprises instructions that, when executed by the at least one processor, further cause the device to:

generate the first audio sample;

generate the second audio sample;

generate a fifth audio sample having a positive peak value equal to or above the first threshold value; and generate the audio test signal including the first audio sample, the second audio sample and the fifth audio sample.

16. The device of claim 14, wherein the memory further comprises instructions that, when executed by the at least one processor, further cause the device to:

send, by the first component to the second component after the first time, one or more audio samples;

determine, by the first component based on the timestamp value, a third number of the one or more audio samples sent between the first time and the second time; and determining a fourth number of audio samples in the audio pipeline based on the third number of the one or more audio samples and a fifth number of audio samples included in the audio test signal.

17. The device of claim 14, wherein the memory further comprises instructions that, when executed by the at least one processor, further cause the device to:

receive the audio data including the fourth audio sample; and receive an indication of the third time at which to output the fourth audio sample.

18. The device of claim 14, wherein the memory further comprises instructions that, when executed by the at least one processor, further cause the device to:

receive first audio data;

determine a frequency offset between the first component and a third component on a separate device;

generate second audio data using the first audio data by one of:

remove at least one sample of the first audio data per cycle based on the frequency offset, add a duplicate copy of at least one sample of the first audio data to the first audio data per cycle based on the frequency offset, or interpolate between adjacent samples of the first audio data to either add or delete samples fractionally;

send the second audio data to the loudspeaker.

19. The device of claim 14, wherein the memory further comprises instructions that, when executed by the at least one processor, further cause the device to:

receive, by an audio mixer, the first audio sample having the positive peak value;

receive, by the audio mixer, a fifth audio sample having a second peak value;

determine a sum of the positive peak value and the second peak value;

determine that the sum exceeds a saturation threshold;

generate a sixth audio sample, a peak value of the sixth audio sample corresponding to the saturation threshold; and send the sixth audio sample to the second component instead of the first audio sample.

20. The device of claim 14, wherein the memory further comprises instructions that, when executed by the at least one processor, further cause the device to:

determine a timer offset between a first timer associated with the first component and a second timer associated with the second component;

determine, using the first timer, a second timestamp value corresponding to the first time;

determine, using the second timer, the timestamp value corresponding to the second time;

determine, based on the timestamp value and the timer offset, a third timestamp value corresponding to the second time and associated with the first timer; and determine the playback delay by subtracting the third timestamp value from the second timestamp value.

21. A computer-implemented method, comprising:

sending, by a first component of a device to a second component of the device at a first time, an audio test signal, the audio test signal comprising at least a first audio sample having a positive peak value equal to or above a first threshold value and a second audio sample having a negative peak value equal to or below a second threshold value;

detecting, by the second component at a second time, the audio test signal by detecting a third audio sample having a peak value above the first threshold value or below the second threshold value;

determining, by the second component, a timestamp value corresponding to the second time;

sending, by the second component to the first component, the timestamp value; and determining, by the first component based on the timestamp value, a playback delay value corresponding to a difference between the first time and the second time;

receiving first audio data;

determining a frequency offset between the first component and a third component on a separate device;

generating second audio data using the first audio data by one of:

removing at least one sample of the first audio data per cycle based on the frequency offset, adding a duplicate copy of at least one sample of the first audio data to the first audio data per cycle based on the frequency offset, or interpolating between adjacent samples of the first audio data to either add or delete samples fractionally; and sending the second audio data to a loudspeaker.

22. A computer-implemented method, comprising:

receiving, by an audio mixer of a device, a first audio sample having a positive peak value equal to or above a first threshold value;

receiving, by the audio mixer, a second audio sample having a second peak value;

determining a sum of the positive peak value and the second peak value;

determining that the sum exceeds a saturation threshold;

generating a third audio sample, a peak value of the third audio sample corresponding to the saturation threshold;

sending, by a first component of the device to a second component of the device at a first time, an audio test signal, the audio test signal comprising at least the third audio sample and a fourth audio sample having a negative peak value equal to or below a second threshold value;

detecting, by the second component at a second time, the audio test signal by detecting a fifth audio sample having a peak value above the first threshold value or below the second threshold value;

determining, by the second component, a timestamp value corresponding to the second time;

sending, by the second component to the first component, the timestamp value; and determining, by the first component based on the timestamp value, a playback delay value corresponding to a difference between the first time and the second time.

* * * * *